US005858611A

United States Patent [19]

Fukui et al.

[11] Patent Number: 5,858,611

[45] Date of Patent: Jan. 12, 1999

[54] DEVELOPMENT PROCESSING METHOD OF SILVER HALIDE BLACK-AND-WHITE PHOTOGRAPHIC MATERIAL

[75] Inventors: Kouta Fukui; Shinnichi Morishima, both of Kanagawa, Japan

[73] Assignee: Fuji Photo Film Co., Ltd., Kanagawa, Japan

[21] Appl. No.: 853,252

[22] Filed: May 9, 1997

Related U.S. Application Data

[63] Continuation of Ser. No. 520,566, Aug. 29, 1995, abandoned.

[30] Foreign Application Priority Data

Oct. 14, 1994 [JP] Japan ..... 6-274254

[51] Int. Cl.[6] ..... G03C 5/29

[52] U.S. Cl. ..... 430/264; 430/440; 430/446

[58] Field of Search ..... 430/264, 435, 430/436, 437, 440, 441, 442, 446, 448, 478, 480, 483

[56] References Cited

U.S. PATENT DOCUMENTS

| | | | |
|---|---|---|---|
| 4,937,160 | 6/1990 | Ruger | 430/441 |
| 5,098,819 | 3/1992 | Knapp | 430/436 |
| 5,217,842 | 6/1993 | Kojima et al. | 430/436 |
| 5,236,816 | 8/1993 | Purol et al. | 430/492 |
| 5,264,323 | 11/1993 | Purol et al. | 430/264 |
| 5,278,035 | 1/1994 | Knapp | 430/436 |
| 5,284,733 | 2/1994 | Kojima et al. | 430/264 |
| 5,372,911 | 12/1994 | Obi et al. | 430/264 |
| 5,376,510 | 12/1994 | Parker et al. | 430/440 |
| 5,384,232 | 1/1995 | Bishop et al. | 430/440 |
| 5,397,687 | 3/1995 | Willems et al. | 430/436 |
| 5,474,879 | 12/1995 | Fitterman et al. | 430/440 |
| 5,503,965 | 4/1996 | Okutsu | 430/399 |

FOREIGN PATENT DOCUMENTS 9311456 6/1993 WIPO .

*Primary Examiner*—Hoa Van Le

*Attorney, Agent, or Firm*—Sughrue, Mion, Zinn, Macpeak & Seas, PLLC

[57] ABSTRACT

A development processing method of a silver halide black-and-white photographic material is described, which comprises the steps of (a) exposing a silver halide photographic material comprising a support having thereon at least one light-sensitive silver halide emulsion layer, and (b) developing the exposed silver halide photographic material with a developer, wherein at least one layer of the light-sensitive silver halide emulsion layer and a hydrophilic colloid layer contains at least one hydrazine derivative represented by the following formula (I); the developer contains substantially no dihydroxybenzene compound; and the developer contains (1) a developing agent selected from ascorbic acid, erythorbic acid and derivatives thereof, (2) a developing agent represented by the following formula (II), and (3) an auxiliary developing agent exhibiting a superadditive property.

(I)

(II)

The formulae (I) and (II) are described in the specification in detail.

12 Claims, No Drawings

DEVELOPMENT PROCESSING METHOD OF SILVER HALIDE BLACK-AND-WHITE PHOTOGRAPHIC MATERIAL

This is a Continuation of application Ser. No. 08/520,566 filed Aug. 29, 1995, now abandoned.

FIELD OF THE INVENTION

The present invention relates to a development processing method for forming an ultrahigh contrast image using a silver halide photographic material with a stable developer containing no dihydroxybenzene developing agent.

BACKGROUND OF THE INVENTION

In the field of graphic arts, a system for forming an image having a photographic characteristic of ultrahigh contrast (especially γ of 10 or more) is required for enabling reproduction of a continuous resolution image through a half-tone image or reproduction of a line original image.

As a process for obtaining photographic characteristics of high contrast image, a lith developing method utilizing what is called an "infectious developing effect" has been used for a long time, but it has the disadvantage that the developer is unstable and, thus, it is difficult to be used.

On the other hand, processes for obtaining a high contrast image using a more stable developer are disclosed in, for example, U.S. Pat. Nos. 4,224,401, 4,168,977, 4,166,742, 4,311,781, 4,272,606, 4,221,857, 4,332,878, 4,634,661, 4,618,574, 4,269,922, 5,650,746, and 4,681,836.

These image forming systems are those in which a hydrazine derivative-added surface latent image type silver halide photographic material is processed with a stable MQ developer (a developer containing hydroquinone and p-aminophenols in combination) or PQ developer (a developer containing hydroquinone and 1-phenyl-3-pyrazolidones in combination) having a pH value of from 11 to 12.3 to obtain an ultrahigh contrast negative image having a γ value exceeding 10. According to these processes, because photographic characteristics of ultrahigh contrast and high sensitivity are obtained and a sulfite can be added to a developer in a high concentration, the stability of the developer to air oxidation is markedly improved in comparison with the conventional lith developer.

With regard to a photographic material for light room developing, which is used in assembly processes and dot-to-dot working operations, for example, in the case where the superimposition dot-to-dot working operation between a half-tone dot text and line original text is attempted to be carried out faithfully to the texts, a process for forming an image having an ultrahigh contrast is required. For this purpose, the above-mentioned image forming systems using a hydrazine derivative are effective, and the typical application examples are disclosed in JP-A-62-640 (the term "JP-A" used herein means an "unexamined published Japanese patent application"), JP-A-62-235938, JP-A-62-235939, JP-A-63-104046, JP-A-63-103235, JP-A-63-296031, JP-A-63-314541, and JP-A-64-13545.

U.S. Pat. Nos. 4,998,604 and 4,994,365 disclose a hydrazine compound having ethylene oxide repeating units and a hydrazine compound having a pyridinium group. However, as is clear from examples described therein, the high contrast is not yet sufficient, and it is difficult to obtain a high contrast and a necessary $D_{max}$ value under the practical developing conditions.

On the other hand, it has been known that endiols such as ascorbic acid can function as the main developing agent, and they attracted the attention as the main developing agent having no problem in terms of ecology and toxicology. For example, U.S. Pat. Nos. 2,688,549 and 3,826,654 disclose that images can be formed under a strong alkaline condition of a pH of 12 or more. However, no high contrast image can be obtained in these image forming processes.

Several attempts have been made to increase the contrast in the developing system using ascorbic acid. For example, Zwicky discloses that in the case of using ascorbic acid as a sole main developing agent, a type of lith effect is expressed (*J. Phot. Sc.* Vol. 27, p. 185 (1979)), but the system using ascorbic acid has a low contrast in comparison with a hydroquinone-containing system. U.S. Pat. No. 1,896,022 and JP-B-49-46939 (the term "JP-B" used herein means an "examined Japanese patent publication") disclose a system using a bisquaternary ammonium salt and ascorbic acid in combination, but even though the system has a developing acceleration effect, it has little effect for increasing contrast. JP-A-3-249756 and JP-A-4-32838 also disclose the combination effect of use of ascorbic acid and a quaternary salt, but the resultant images have insufficient contrast. Furthermore, according to JP-A-5-88306, a high contrast can be obtained by using ascorbic acid as a sole developing agent and keeping the pH at 12.0 or more, but this system has a problem in terms of stability of the developer.

U.S. Pat. No. 3,730,727 discloses an example where a special developer comprising ascorbic acid and a hydrazine derivative as main ingredients can be used to obtain a developed system having a high sensitivity and low stain and fogging, but does not disclose enhancement of contrast.

It has been known that a photographic material containing hydrazine is processed with an ascorbic acid developer, and it is disclosed in, for example, U.S. Pat. No. 5,236,816, and WO 93/11456. In each case, a sufficient contrast cannot be obtained. Additionally, in WO 93/11456, although a high contrast is obtained by incorporating an amine compound into a developer, it is not preferable in terms of environment. A development processing method to obtain a high contrast image by using an ascorbic acid developing agent, which is preferred in terms of toxicology, has been desired. However, a sufficient contrast has not been obtained. Furthermore, if an ascorbic acid developing agent is used, the pH is greatly lowered because of air oxidation, and as a result, there have been practical problems because the photographic properties are greatly lowered. In addition, because high contrast images for a printing film are obtained by processing the light-sensitive material with a developer having a relatively high pH of 11 or more, stability for air oxidation in these methods is insufficient.

SUMMARY OF THE INVENTION

An object of the present invention is, therefore, to provide a development processing method, which can give an ultrahigh contrast image, a developer containing no dihydroxybenzene compound, which is ecologically preferred.

This and other objects of the present invention have been attained by a development processing method of a silver halide black-and-white photographic material, which comprises the steps of (a) exposing a silver halide photographic material comprising a support having thereon at least one light-sensitive silver halide emulsion layer, and (b) developing the exposed silver halide photographic material with a developer, wherein at least one layer of the light-sensitive silver halide emulsion layer and a hydrophilic colloid layer contains at least one hydrazine derivative represented by the following formula (I); the developer contains substantially no dihydroxybenzene compound; and the developer contains (1) at least one developing agent selected from ascorbic acid, erythorbic acid and alkali metal salts thereof, (2) a developing agent represented by the following formula (II), and (3) an auxiliary developing agent exhibiting a superadditive property:

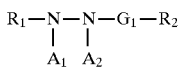

(I)

wherein $R_1$ represents an aliphatic group or an aromatic group; $R_2$ represents a hydrogen atom, an alkyl group, an aryl group, an unsaturated heterocyclic group, an alkoxy group, an aryloxy group, an amino group or a hydrazino group; $G_1$ represents —CO—, —$SO_2$—, —SO—, —PO($R_3$)—, —CO—CO—, a thiocarbonyl group or an iminomethylene group; $A_1$ and $A_2$ are both a hydrogen atom, or one of them is a hydrogen atom and the other is a substituted or unsubstituted alkylsulfonyl group, a substituted or unsubstituted arylsulfonyl group or a substituted or unsubstituted acyl group; $R_3$ has the same meaning as $R_2$, but it may be different from $R_2$:

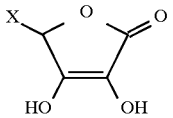

(II)

wherein X represents a hydrogen atom, an aryl group, a heterocyclic group or a group represented by the following formula (A):

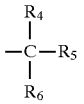

(A)

wherein $R_4$, $R_5$ and $R_6$ are the same or different and each represents a hydrogen atom or a substituent other than a hydroxyl group.

DETAILED DESCRIPTION OF THE INVENTION

The compound represented by formula (I) will now be described in detail.

In formula (I), the aliphatic group represented by $R_1$ is preferably an aliphatic group having from 1 to 30 carbon atoms, more preferably a straight-chain, branched or cyclic alkyl group having from 1 to 20 carbon atoms. The branched alkyl group may be cyclized to form a saturated heterocyclic ring containing one or more hetero atoms in the alkyl group. The alkyl group may be substituted with one or more substituent.

The aromatic group represented by $R_1$ in formula (I) includes a monocyclic or dicyclic aryl or unsaturated heterocyclic group. The unsaturated heterocyclic group represented by $R_1$ may form a heteroaryl group by fusing a monocyclic or dicyclic aryl group. Examples of the ring formed by $R_1$ include a benzene ring, a naphthalene ring, a pyridine ring, a pyrimidine ring, an imidazole ring, a pyrazole ring, a quinoline ring, an isoquinoline ring, a benzimidazole ring, a thiazole ring and a benzothiazole ring. Among these, preferred is a benzene ring.

$R_1$ is more preferably an aryl group.

The aliphatic or aromatic group represented by $R_1$ may be substituted with one or more substituents. Examples of the substituents include an alkyl group, an alkenyl group, an alkynyl group, an aryl group, a heterocyclic group, a pyridinium group, a hydroxyl group, an alkoxy group, an aryloxy group, an acyloxy group, an alkylsulfonyloxy group, an arylsulfonyloxy group, an amino group, a carbonamido group, a sulfonamido group, a ureido group, a thioureido group, a semicarbazido group, a thiosemicarbazido group, a urethane group, a group having a hydrazide structure, a group having a quaternary ammonium structure, an alkylthio group, an arylthio group, an alkylsulfonyl group, an arylsulfonyl group, an alkylsulfinyl group, an arylsulfinyl group, a carboxyl group, a sulfo group, an acyl group, an alkoxycarbonyl group, an aryloxycarbonyl group, a carbamoyl group, a sulfamoyl group, a halogen atom, a cyano group, a phosphonamido group, a diacylamino group, an imido group, a group having an acylurea structure, a group containing a selenium atom or a tellurium atom, and a group having a tertiary sulfonium structure or a quaternary sulfonium structure. Of these, preferred are a strain-chain, branched or cyclic alkyl group (preferably alkyl group having from 1 to 20 carbon atoms), an aralkyl group (preferably monocyclic or dicyclic aralkyl group containing an alkyl moiety having from 1 to 3 carbon atoms), an alkoxy group (preferably alkoxy group having from 1 to 20 carbon atoms), a substituted amino group (preferably amino group substituted with at least one alkyl group having from 1 to 20 carbon atoms), an acylamino group (preferably acylamino group having from 2 to 30 carbon atoms), a sulfonamido group (preferably sulfonamido group having from 1 to 30 carbon atoms), a ureido group (preferably ureido group having from 1 to 30 carbon atoms) and a phosphonamido group (preferably phosphonamido group having from 1 to 30 carbon atoms).

In formula (I), the alkyl group represented by $R_2$ is preferably an alkyl group having from 1 to 4 carbon atoms, and the aryl group represented by $R_2$ is preferably a monocyclic or dicyclic aryl group such as an aryl group containing a benzene ring.

The unsaturated heterocyclic group represented by $R_2$ is preferably a 5- or 6-membered ring containing at least one nitrogen, oxygen or sulfur atom. Examples thereof include an imidazolyl group, a pyrazolyl group, a triazolyl group, a tetrazolyl group, a pyridyl group, a pyridinium group, a quinolinium group and a quinolinyl group. Anong these, more preferred are a pyridyl group and a pyridinium group.

The alkoxy group represented by $R_2$ is preferably an alkoxy group having from 1 to 8 carbon atoms. The aryloxy group represented by $R_2$ is preferably a monocyclic aryloxy group. The amino group represented by $R_2$ is preferably an unsubstituted amino group or an alkylamino or arylamino group having from 1 to 10 carbon atoms.

$R_2$ may be substituted with one or more substituents, and examples of the substituents include those recited above with respect to $R_1$.

When $G_1$ represents —CO—, $R_2$ is preferably a hydrogen atom, an alkyl group (e.g., methyl, trifluoromethyl, 3-hydroxypropyl, 3-methanesulfonamidopropyl, phenylsulfonylmethyl), an aralkyl group (e.g., o-hydroxybenzyl) or an aryl group (e.g., phenyl, 3,5-dichlorophenyl, o-methanesulfonamidophenyl, 4-methanesulfonylphenyl, 2-hydroxymethylphenyl), and more preferably a hydrogen atom or a trifluoromethyl group.

When $G_1$ represents —$SO_2$—, $R_2$ is preferably an alkyl group (e.g., methyl), an aralkyl group (e.g., o-hydroxybenzyl), an aryl group (e.g., phenyl) or a substituted amino group (e.g., dimethylamino).

When $G_1$ represents —CO—CO—, $R_2$ is preferably an alkoxy group, an aryloxy group or an amino group.

In formula (I), $G_1$ is preferably —CO— or —CO—CO—, and more preferably —CO—.

Further, $R_2$ may be a group such that it can split the $G_1$—$R_2$ moiety off the residual molecule and thereby cause the cyclization reaction to form a cyclic structure containing the atoms of the $G_1$—$R_2$ moiety. Specific examples thereof include those disclosed in JP-A-63-29751.

$A_1$ and $A_2$ are each preferably a hydrogen atom, an alkylsulfonyl or arylsulfonyl group having from 1 to 20 carbon atoms (more preferably, a phenylsulfonyl group or a phenylsulfonyl group substituted with substituent(s) having a Hammett's reaction constant of −0.5 or more, such as a p-methylphenylsulfonyl group, a pentafluorophenylsulfonyl group, a p-ethoxycarbonylphenylsulfonyl group, a m-methoxyphenylsulfonyl group and a p-cyanophenylsulfonyl group) or an acyl group having from 1 to 20 carbon atoms (more preferably, a benzoyl group, a benzoyl group substituted with substituent(s) having a Hammett's reaction constant of −0.5 or more, such as a p-methylbenzoyl group, a pentafluorobenzoyl group, a p-ethoxycarbonylbenzoyl group, a m-methoxybenzoyl group and a p-cyanobenzoyl group, or a straight-chain, branched or cyclic acyl group, which may be substituted with substituent(s) such as a halogen atom, an ether group, a sulfonamido group, a carbonamido group, a hydroxyl group, a carboxyl group or a sulfonic acid group), and $A_1$ and $A_2$ are each more preferably a hydrogen atom.

The substituents of $R_1$ and $R_2$ may be further substituted with one or more substituents, and examples of the substituents include those recited above with respect to $R_1$. The substituted substituents may be further substituted with a substituent, a substituted substituent, a ((substituted substituent)-substituted substituent, and so on, and the examples of the substituents also include those recited above with respect to $R_1$.

Moreover, $R_1$ or $R_2$ in formula (I) may be a group into which a ballast group used commonly in immobile photographic additives, such as couplers, or a polymer is introduced. The ballast group is a group containing 8 or more carbon atoms and having a relatively slight influence upon photographic properties, and examples thereof include an alkyl group, an aralkyl group, an alkoxy group, a phenyl group, an alkylphenyl group, a phenoxy group, and an alkylphenoxy group. Examples of the polymer include those described in JP-A-1-100530.

Furthermore, $R_1$ or $R_2$ in formula (I) may be a group into which a group capable of intensifying the adsorption onto the grain surface of silver halide is introduced. Examples of the adsorption-intensifying group include an alkylthio group, an arylthio group, a thiourea group, a heterocyclic thioamido group, a mercapto heterocyclic group and a triazole group, such as described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245 and JP-A-63-234246.

The particularly preferred hydrazine derivative in the present invention is a hydrazine derivative represented by formula (I), wherein $R_1$ is a ballast group via a sulfonamido group, an acylamino group or a ureido group, a group capable of accelerating the adsorption onto a surface of silver halide grains, a group having a quaternary ammonium structure or a phenyl group having an alkylthio group; $G_1$ is —CO—; $R_2$ is a hydrogen atom or a substituted alkyl or substituted aryl group (the substituent thereof is preferably an electron attracting group or a hydroxymethyl group to the 2-position thereof). All the combinations of the above-described $R_1$ and $R_2$ can be selected and are preferred.

Specific examples of the compound represented by formula (I) are illustrated below. However, the present invention should not be construed as being limited to these examples.

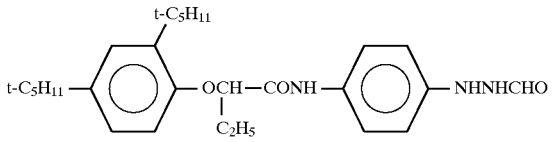

I-1

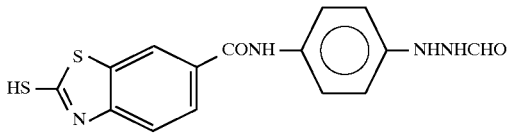

I-2

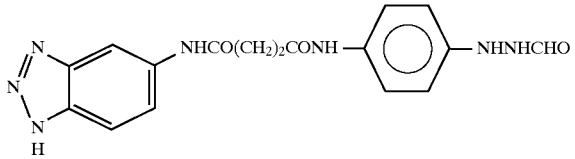

I-3

-continued
I-4
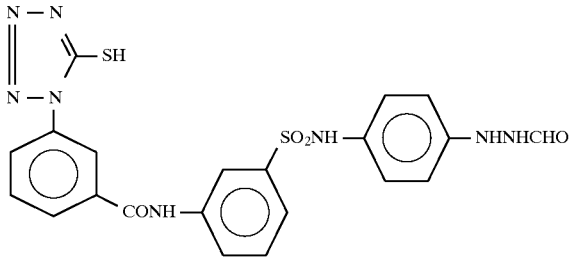
I-5
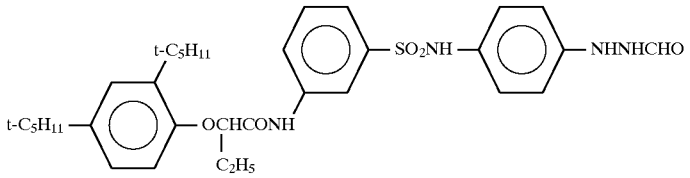
I-6
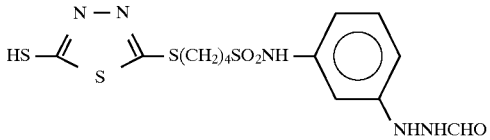
I-7
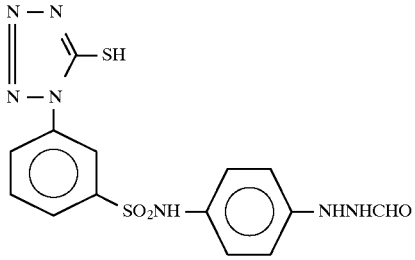
I-8
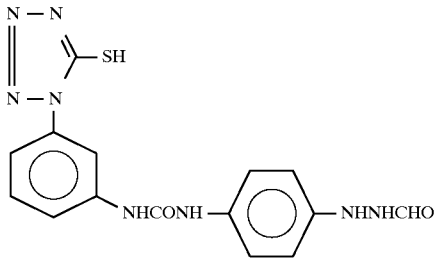
I-9
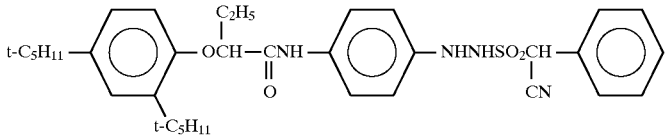
I-10
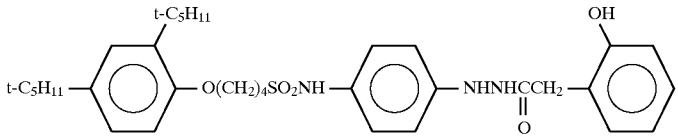
I-11
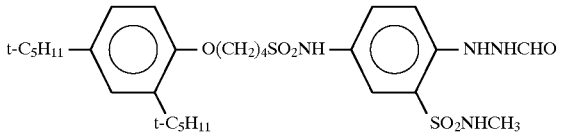

-continued
I-12
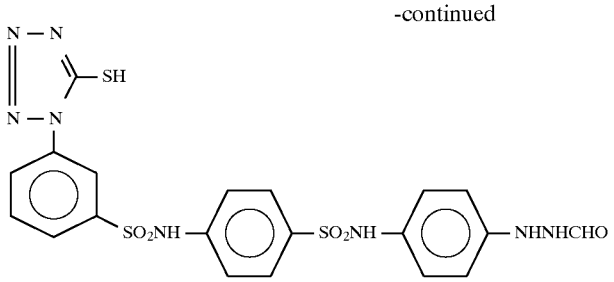
I-13
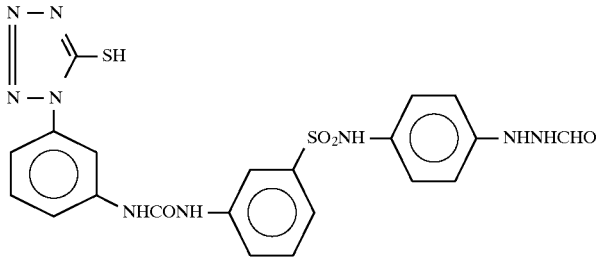
I-14
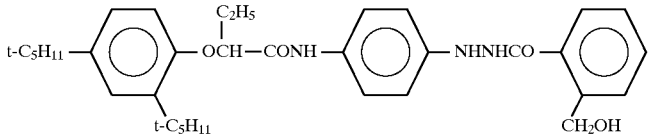
I-15
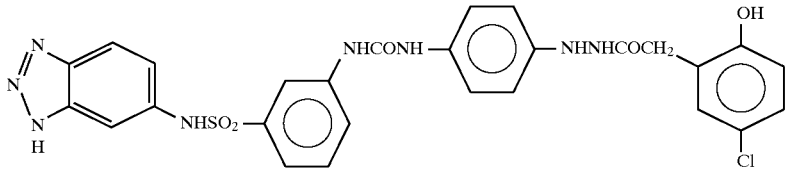
I-16
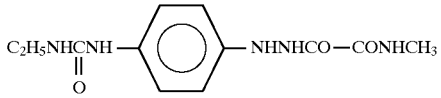
I-17
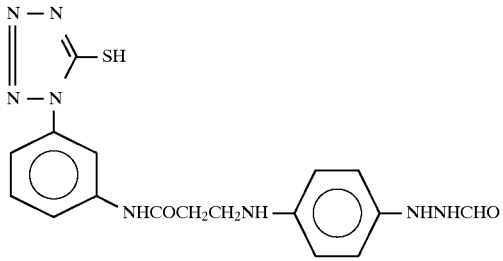
I-18
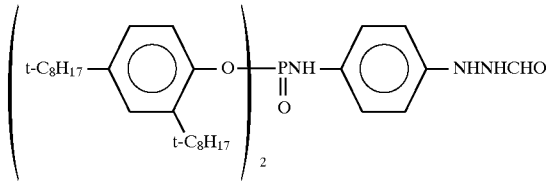
I-19
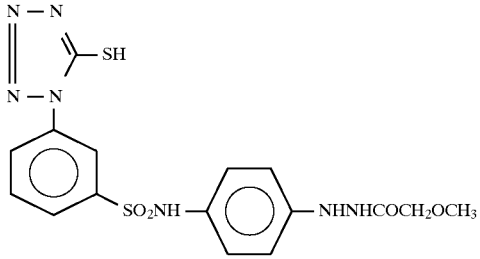

-continued
I-20
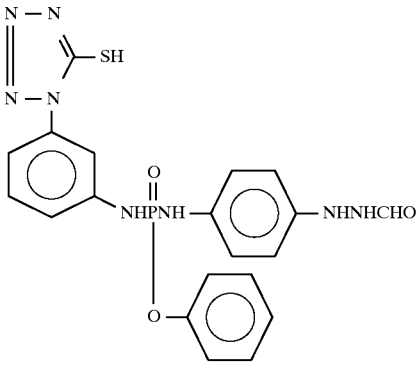
I-21
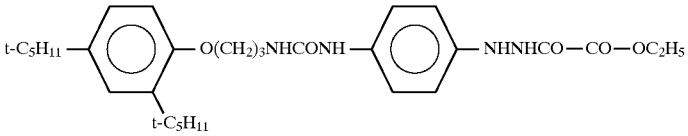
I-22
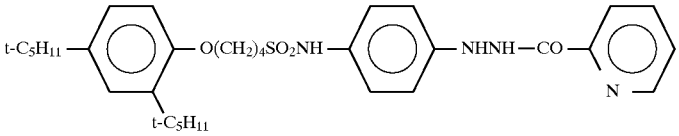
I-23
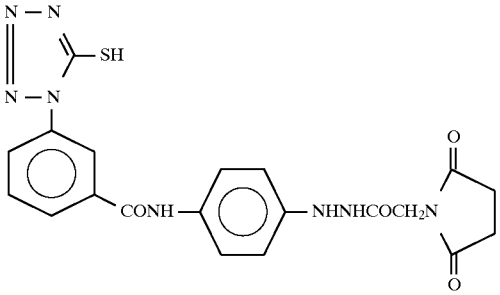
I-24
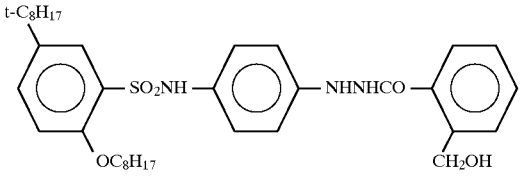
I-25
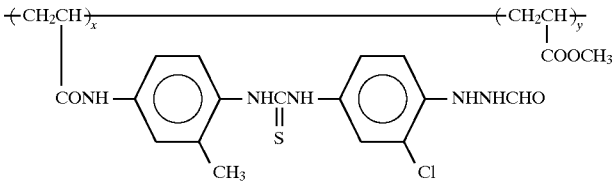
x:y = 3:97
Average molecular weight
= about 100,000
I-26
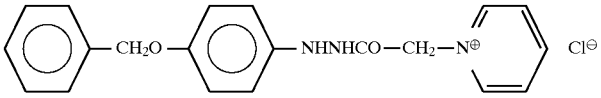
I-27
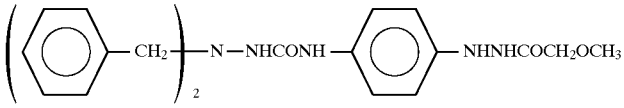

-continued
I-28
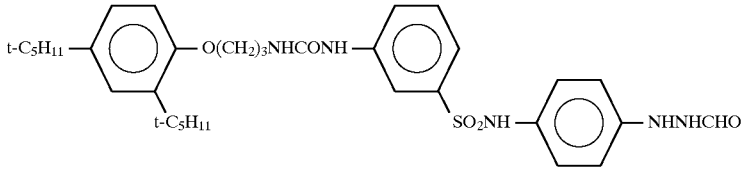
I-29
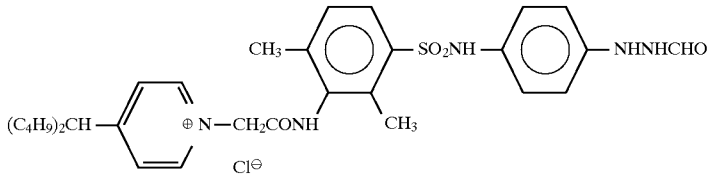
I-30
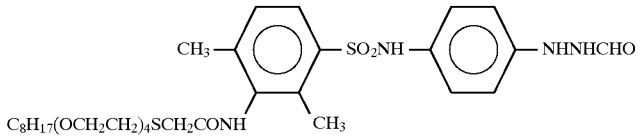
I-31
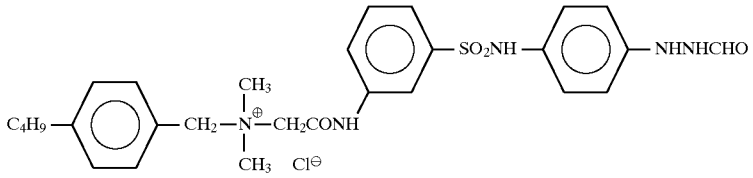
I-32
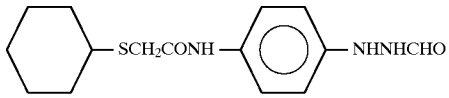
I-33
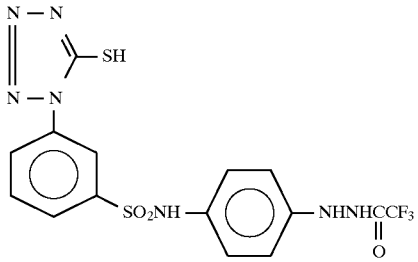
I-34
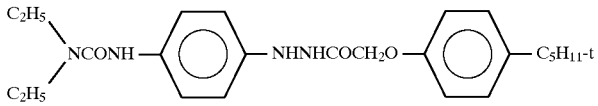
I-35
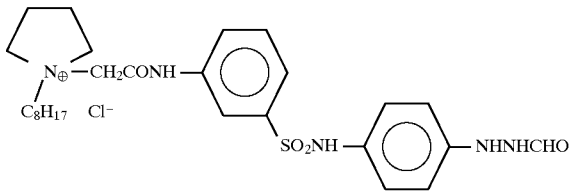
I-36
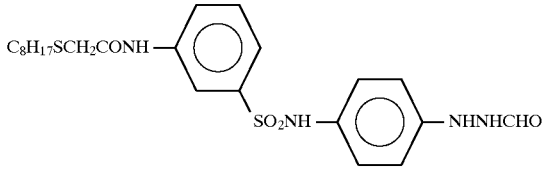

-continued
I-37
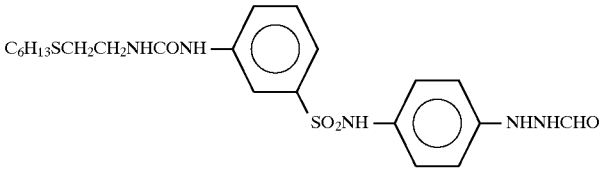
I-38
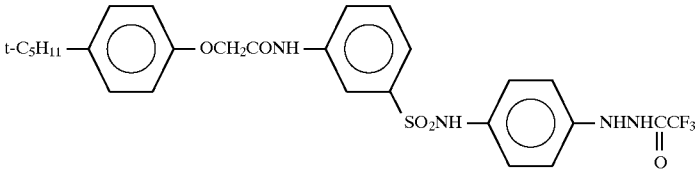
I-39
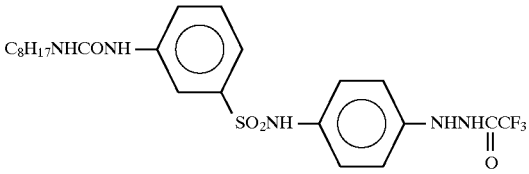
I-40
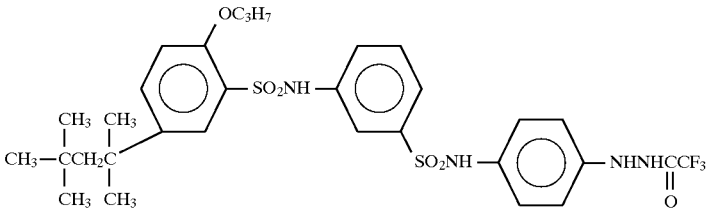
I-41
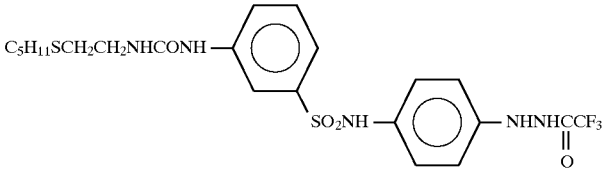
I-42
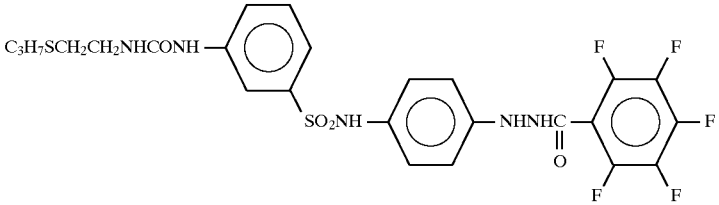
I-43
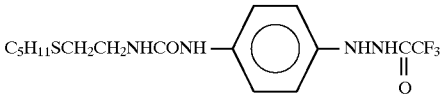
I-44
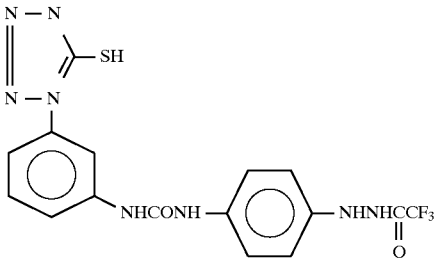

-continued
I-45
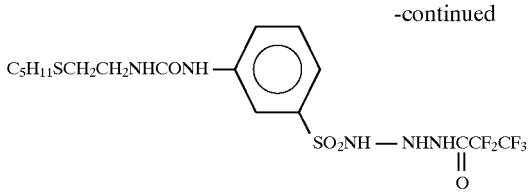
I-46
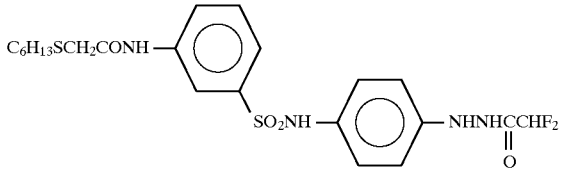
I-47
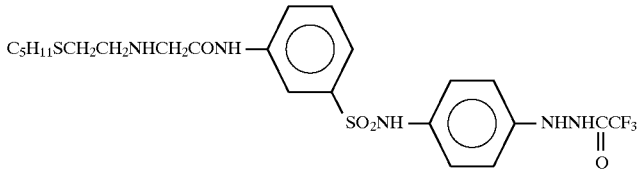
I-48
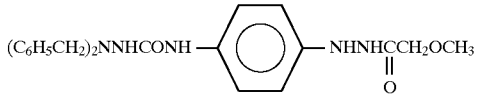
I-49
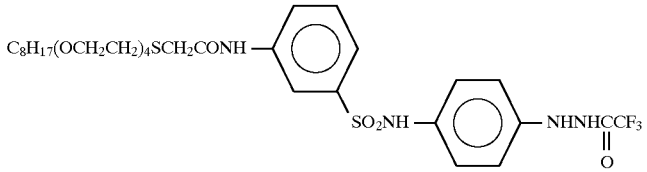
I-50
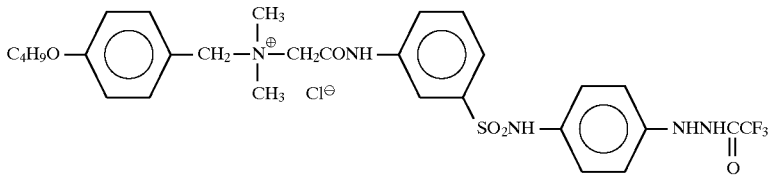
I-51
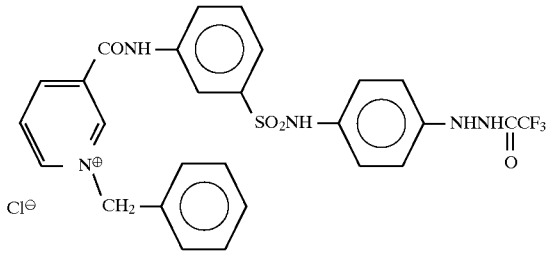
I-52
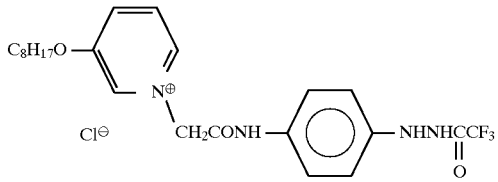
I-53
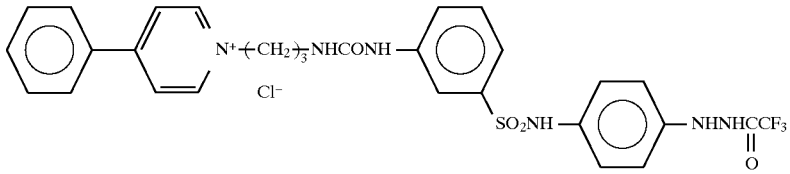

In addition to the above-illustrated ones, hydrazine derivatives which can be used in the present invention include those disclosed in *Research Disclosure,* Item 23516, page 346 (November 1983), the references cited in ibid., U.S. Pat. Nos. 4,080,207, 4,269,929, 4,276,364, 4,278,748, 4,385,108, 4,459,347, 4,478,928, 4,560,638, 4,686,167, 4,912,016, 4,988,604, 4,994,365, 5,041,355 and 5,104,769, British Patent No. 2,011,391B, European Patent Nos. 217, 310, 301,799 and 356,898, JP-A-60-179734, JP-A-61-170733, JP-A-61-270744, JP-A-62-178246, JP-A-63-32538, JP-A-63-104047, JP-A-63-121838, JP-A-63-129337, JP-A-63-223744, JP-A-63-234244, JP-A-63-234245, JP-A-63-234246, JP-A-63-294552, JP-A-63-306438, JP-A-64-10233, JP-A-1-90439, JP-A-1-100530, JP-A-1-105941, JP-A-1-105943, JP-A-1-276128, JP-A-1-280747, JP-A-1-283548, JP-A-1-283549, JP-A-1-285940, JP-A-2-2541, JP-A-2-77057, JP-A-2-139538, JP-A-2-196234, JP-A-2-196235, JP-A-2-198440, JP-A-2-198441, JP-A-2-198442, JP-A-2-220042, JP-A-2-221953, JP-A-2-221954, JP-A-2-285342, JP-A-2-285343, JP-A-2-289843, JP-A-2-302750, JP-A-2-304550, JP-A-3-37642, JP-A-3-54549, JP-A-3-125134, JP-A-3-184039, JP-A-3-240036, JP-A-3-240037, JP-A-3-259240, JP-A-3-280038, JP-A-3-282536, JP-A-4-51143, JP-A-4-56842, JP-A-4-84134, JP-A-2-230233, JP-A-4-96053, JP-A-4-216544, JP-A-5-45761, JP-A-5-45762, JP-A-5-45763, JP-A-5-45764 and JP-A-5-45765, and JP-A-6-289542.

The hydrazine derivative for use in the present invention is preferably added in an amount of from $1\times10^{-6}$ to $5\times10^{-2}$ mol, more preferably from $1\times10^{-5}$ to $2\times10^{-2}$ mol, per mol of silver halide.

In using the hydrazine derivative in the present invention, it may be dissolved in a proper water-miscible organic solvent, such as alcohol (e.g., methanol, ethanol, propanol, fluorinated alcohol), ketone (e.g., acetone, methyl ethyl ketone), dimethylformamide, dimethylsulfoxide and methyl cellosolve.

Furthermore, the hydrazine derivative can be used in the form of emulsified dispersion, which is prepared by using well-known emulsion dispersion methods in which the hydrazine derivative is dissolved by using an oil such as dibutyl phthalate, tricresyl phosphate, glyceryl triacetate and diethyl phthalate, together with an auxiliary solvent, such as ethyl acetate and cyclohexanone, and then dispersed mechanically in an emulsified condition. On the other hand, the so-called solid dispersion method can be adopted in using the hydrazine derivative, wherein the powdered hydrazine derivative is dispersed into water with a ball mill, a colloid mill or ultrasonic waves.

The hydrazine derivative may be contained in fine polymer particles as described in JP-A-2-948.

When the silver halide photographic material is processed with a developer having a pH of less than 11, nucleating accelerators such as amine derivatives, onium salts, disulfide derivatives, hydroxylamine derivatives, acetylene derivatives and urea derivatives are preferably added to a silver halide emulsion layer or other hydrophilic colloid layer(s) in the photographic material.

The amine derivatives include compounds described in, for example, JP-A-60-140340, JP-A-62-50829, JP-A-62-222241, JP-A-62-250439, JP-A-62-280733, JP-A-63-124045, JP-A-63-133145, and JP-A-63-286840. The amine derivatives are preferably compounds having a group adsorbing on silver halides described in JP-A-63-124045, JP-A-63-133145, and JP-A-63-286840, compounds having 20 or more total carbon atoms described in JP-A-62-222241, amine compounds having an ethylene group described in U.S. Pat. Nos. 4,975,354 and EP-A-458706, and compounds described in JP-A-62-50829.

The onium salts preferably include pyridinium salts, ammonium salts and phosphonium salts. Examples of the pyridinium salts include compounds described in JP-A-6-242534. Examples of the ammonium salts include compounds described in JP-A-62-250439 and JP-A-62-280733. Examples of the phosphonium salts include compounds described in JP-A-61-167939 and JP-A-62-280733.

The disulfide derivatives include compounds described in JP-A-61-198147.

The hydroxymethyl derivatives include compounds described in U.S. Pat. Nos. 4,698,956, 4,777,118, EP-A-231850 and JP-A-62-50829, and are preferably diarylmethacrylate derivatives.

The acetylene derivatives include compounds described in JP-A-3-168735 and JP-A-2-271351.

The urea derivatives include compounds described in JP-A-3-168736.

Specific examples of the nucleating accelerator are shown below. However, the present invention is not limited thereto.

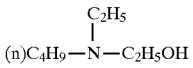
A-1)

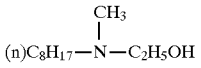
A-2)

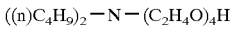
A-3)

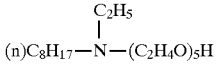
A-4)

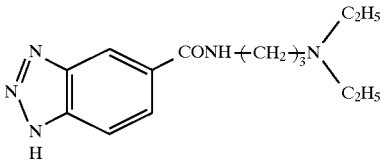
A-5)

-continued
A-6)
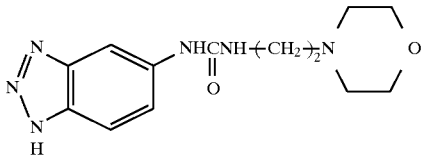
A-7)
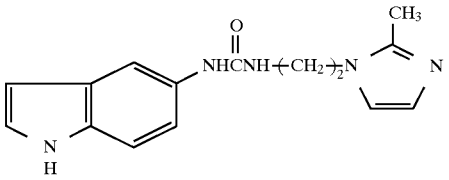
A-8)
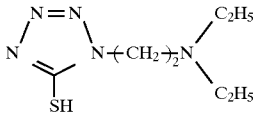
A-9)
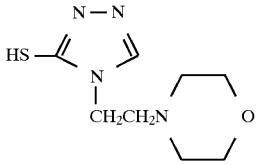
A-10)
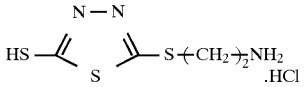
A-11)
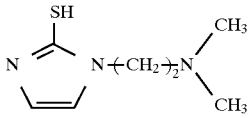
A-12)
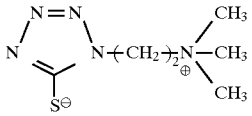
A-13)
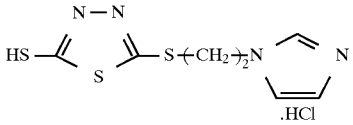
A-14)
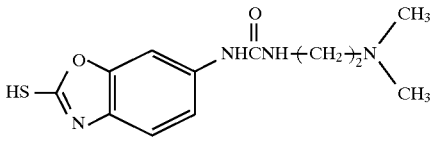
A-15)
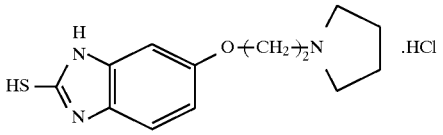
A-16)
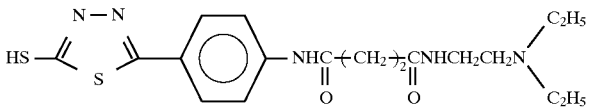

-continued
A-17)
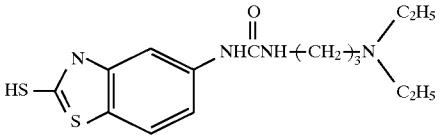
A-18)
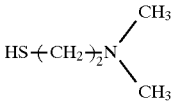
A-19)
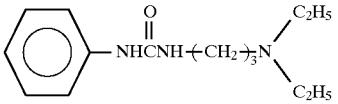
A-20)
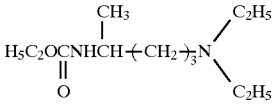
A-21)
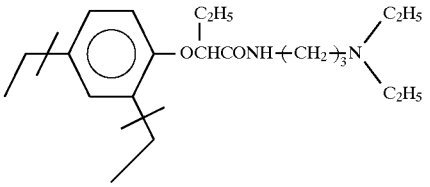
A-22)
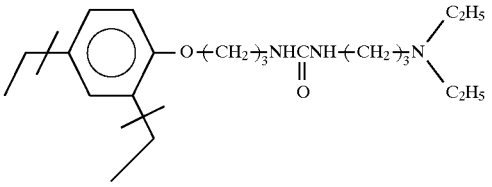
A-23)
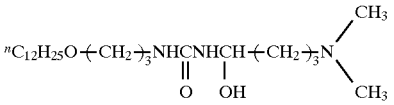
A-24)
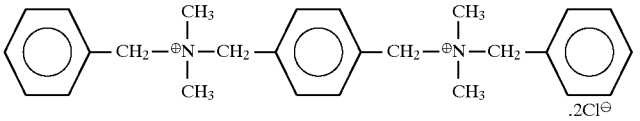
A-25)
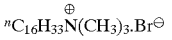
A-26)
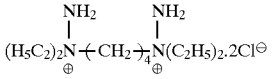
A-27)
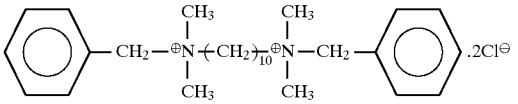
A-28
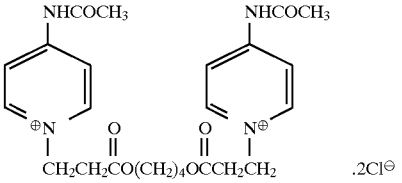

-continued
A-29
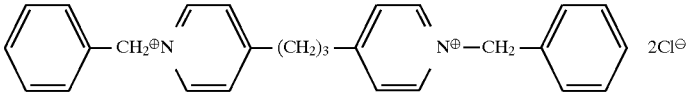
A-30
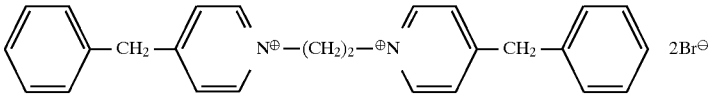
A-31
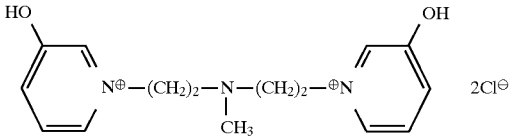
A-32
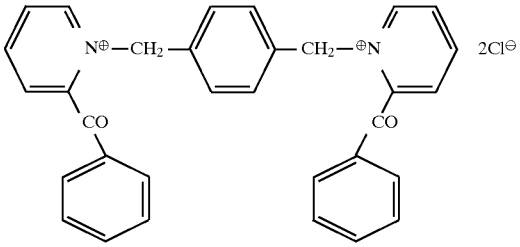
A-33
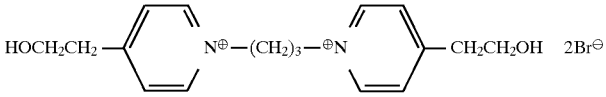
A-34
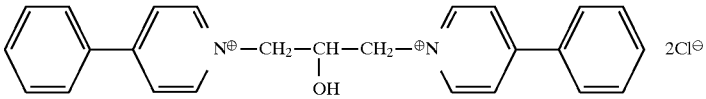
A-35
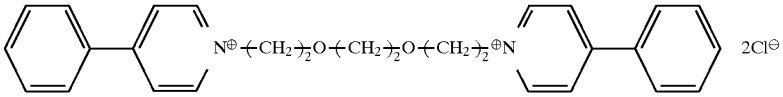
A-36
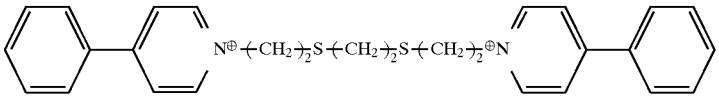
A-37
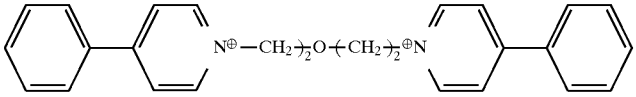
A-38
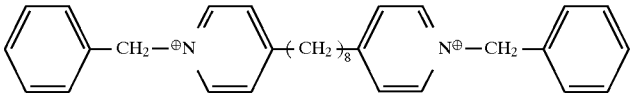
A-39
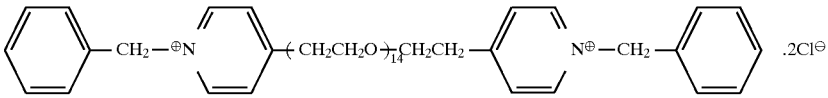
A-40
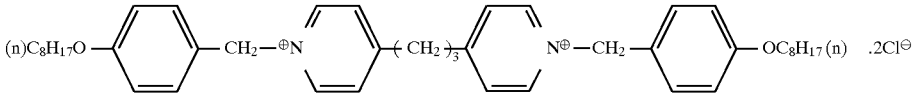
A-41
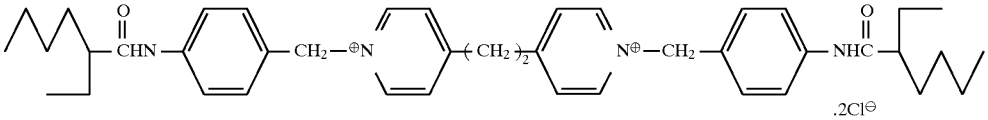

-continued
A-42
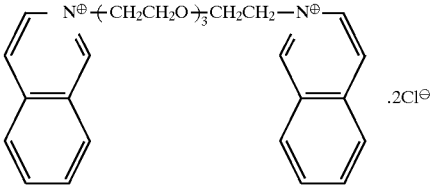
A-43
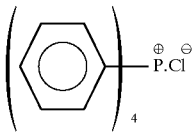
A-44
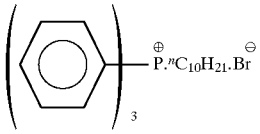
A-45
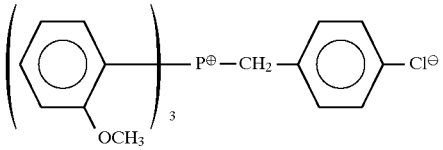
A-46
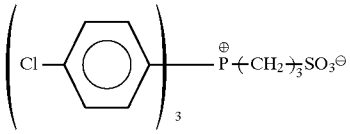
A-47
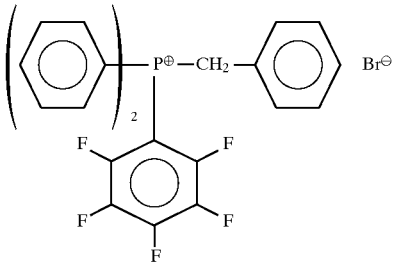
A-48
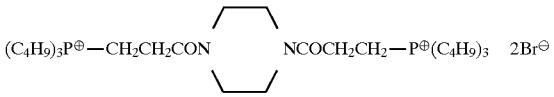
A-49
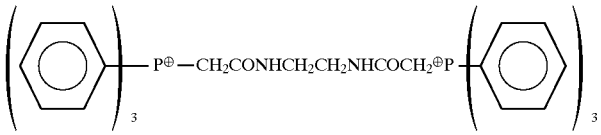
A-50
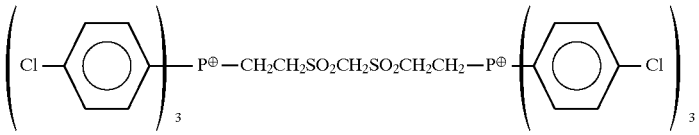

-continued
A-51
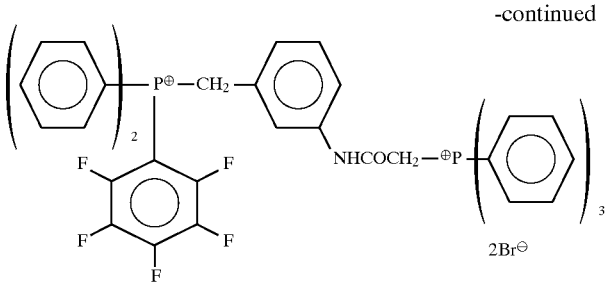
A-52
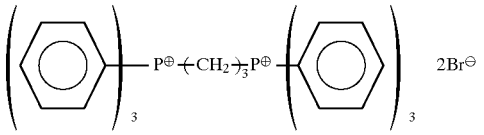
A-53
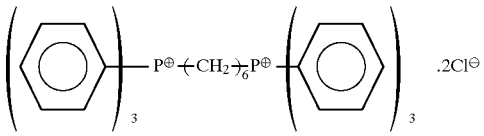
A-54
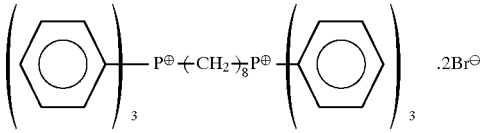
A-55
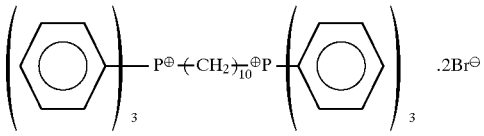
A-56
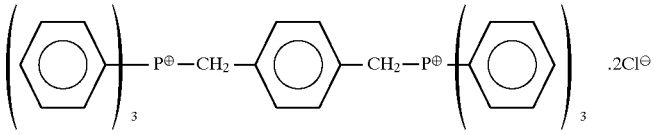
A-57
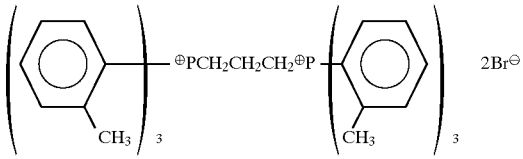
A-58
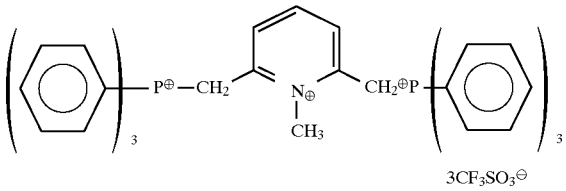
A-59
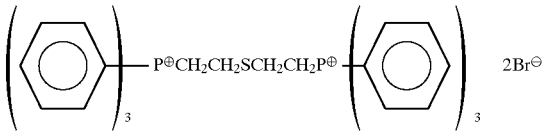
A-60
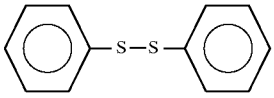
A-61
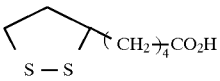

-continued

A-62

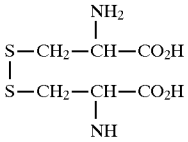

A-63

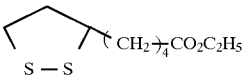

A-64

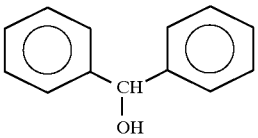

A-65

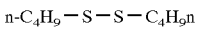

A-66

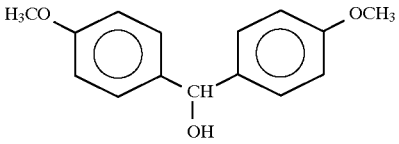

A-67

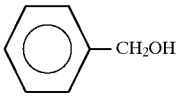

A-68

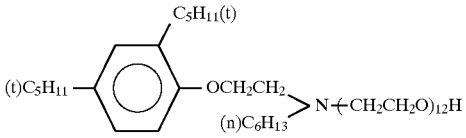

A-69

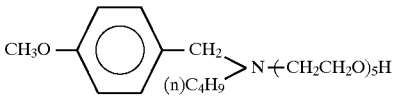

A-70

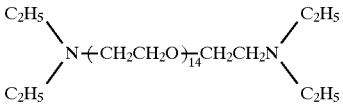

A-71

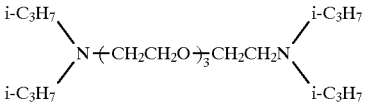

A-72

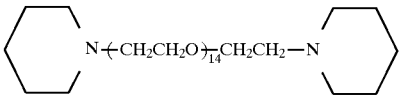

A-73

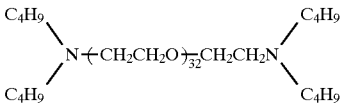

The preferable amount added of these compounds depends on the kind thereof. However, they are preferably added in an amount of from $1.0\times10^{-2}$ to $1.0\times10^{2}$ mol, more preferably from $1.0\times10^{-1}$ to $5\times10$ mol, per mol of the hydrazine compound.

These compounds may be dissolved in a water-miscible organic solvent, such as alcohols (e.g., methanol, ethanol, propanol, fluorinated alcohol), ketones (e.g., acetone, methyl ethyl ketone), dimethylformamide, dimethylsulfoxide, and methyl cellosolve.

Furthermore, they may be dissolved in oils, such as dibutyl phthalate, tricresyl phosphate, glyceryl triacetate and diethyl phthalate, or auxiliary solvents, such as ethyl acetate and cyclohexanone, to mechanically prepare emulsified dispersion according to known emulsified dispersion methods. Also, powders of these compounds may be dispersed in water with a ball mill, a colloid mill or ultrasonic waves according to known solid dispersion methods.

The silver halide of the silver halide emulsion for use in the present invention is preferably silver chloride, or silver bromochloride or silver bromoiodochloride having a sliver chloride content of 50 mol % or more. The content of silver iodide is preferably less than 5 mol %, more preferably less than 2 mol %.

In the present invention, the light-sensitive material suitable for high illumination exposure such as scanner exposure and the light-sensitive material suitable for line work photographing preferably contains a rhodium compound to obtain a high contrast and a low fog.

The rhodium compounds for use in the present invention include water-soluble ones. Suitable examples thereof include a rhodium(III) halide compound and a rhodium complex salt containing as a ligand halogen, amine, oxalate, such as a hexachlororhodium(III) complex salt, a hexabromorhodium(III) complex salt, a hexaamminerhodium(III) complex salt and a trioxalatorhodium(III) complex salt. In using these rhodium compounds, they are dissolved in water or an appropriate solvent. In order to stabilize the solution of a rhodium compound, a conventional method, that is, a method of adding an aqueous solution of halogenated acid (e.g., hydrochloric acid, hydrobromic acid, hydrofluoric acid) or an alkali halide (e.g., KCl NaCl, KBr, NaBr), can be adopted. Instead of using a water-soluble rhodium compound, it is possible to incorporate rhodium into emulsion grains by adding rhodium-doped silver halide grains to the silver halide preparation system and dissolving the grains therein.

The amount added of the rhodium compound is from $1\times10^{-8}$ to $5\times10^{-6}$ mol, preferably from $5\times10^{-8}$ to $1\times10^{-6}$, per mol of silver of silver halide emulsion.

These compounds can be properly added at the time silver halide emulsion grains are formed, or at any stage prior to the emulsion coating. In particular, they are preferably added before physical ripening of the silver halide forming step, more preferably at the time the emulsion is formed, and thereby to be incorporated into silver halide grains.

Photographic emulsions for use in the present invention can be prepared using methods described in, e.g., P. Glafkides, *Chemie et Physique Photographique*, Paul Montel, Paris (1967), G. F. Duffin, *Photographic Emulsion Chemistry*, The Focal Press, London (1966), V. L. Zelikman et al, *Making and Coating Photographic Emulsion*, The Focal Press, London (1964).

Examples of methods for reacting a water-soluble silver salt with a water-soluble halide include a single jet method, a double jet method, and a combination thereof.

A method in which silver halide grains are produced in the presence of excess silver ion (what is called reverse mixing method) can be employed. On the other hand, the controlled double jet method, in which the pAg of the liquid phase wherein silver halide grains are to be precipitated is maintained constant, may be employed. Further, it is preferred to carry out the grain formation using the so-called silver halide solvent, such as ammonia, thioethers and tetrasubstituted thioureas. Preferably, tetrasubstituted thioureas are used as the silver halide solvent, which are disclosed in JP-A-53-82408 and JP-A-55-77737. As for the thioureas, tetramethylthiourea and 1,3-dimethyl-2-imidazolinethione are preferably used.

According to the controlled double jet method and the grain formation method using a silver halide solvent, a silver halide emulsion having a regular crystal shape and a narrow distribution of grain sizes can be obtained with ease, and so these methods are useful for making the silver halide emulsions used in the present invention.

For the purpose of rendering the grain sizes uniform, it is also preferred that the grain growth is accelerated within the limits of critical saturation degree by using a method of changing the addition speed of silver nitrate or an alkali halide depending on the speed of grain growth, as described in British Patent No. 1,535,016, JP-B-48-36890 and JP-B-52-16364, or a method of changing the concentrations of the aqueous solutions, as described in British Patent No. 4,242,445 and JP-A-55-158124.

The emulsion for use in the present invention is preferably a monodispersion, and the variation coefficient thereof is 20% or less, preferably 15% or less.

The average grain size of the monodispersion silver halide emulsion is preferably from 0.5 $\mu$m or less, and more preferably from 0.1 to 0.4 $\mu$m.

The silver halide emulsions for use in the present invention may be preferably chemically sensitized. Examples of the chemical sensitization include known methods, such as a sulfur sensitization method, a selenium sensitization method, a tellurium sensitization method, a noble metal sensitization method, and a reduction sensitization method. These methods can be used alone or in combination. In the combined use, it is preferred to combine, e.g., a sulfur sensitization method and a gold sensitization method, a sulfur sensitization method, a selenium sensitization and a gold sensitization method, or a sulfur sensitization method, a tellurium sensitization method and a gold sensitization method.

In the sulfur sensitization method in the present invention, the sensitization can be generally carried out by adding a sulfur sensitizer to an emulsion and stirring the emulsion for a prescribed time under a temperature of 40° C. or more. As for the sulfur sensitizer, known compounds such as thiosulfates, thioureas, thiazoles, and rhodanines in addition to sulfur compounds contained in gelatin can be used. Of these sulfur sensitizers, thiosulfates and thiourea compounds are preferred. The amount added of a sulfur sensitizer is, though depending on various conditions, such as the pH and the temperature at the time of chemical sensitization and the size of silver halide grains, from $10^{-7}$ to $10^{-2}$ mol, preferably from $10^{-5}$ to $10^{-3}$ mol, per mol of silver halide.

Selenium sensitizers for use in the present invention include known selenium compounds. In general, selenium sensitization can be carried out by adding an unstable selenium compound and/or a nonunstable selenium compound to the silver halide emulsion and stirring the resulting emulsion at a high temperature, preferably 40° C. or more, for a definite time. Suitable examples of the unstable selenium compounds include those disclosed in JP-B-44-15748, JP-B-43-13489, JP-A--4-25832, JP-A-4-107442 and JP-A-4-324855. The compounds represented by formula (VIII) or (IX) described in JP-A-4-324855 are preferably used. On the other hand, examples of the nonunstable selenium compounds which can be used in the present invention include those disclosed in JP-B-46-4553, JP-B-52-34492 and JP-B-52-34491.

Tellurium sensitizers for use in the present invention are compounds capable of producing silver telluride, which is presumed to act as a sensitization nucleus, at the surface or the inside of silver halide grains. The production rate of silver telluride in a silver halide emulsion can be examined by the method disclosed in JP-A-5-313284.

Specific examples of the tellurium sensitizers include the compounds disclosed in U.S. Pat. Nos. 1,623,499, 3,320,069 and 3,772,031; British Patent Nos. 235,211, 1,121,496, 1,295,462 and 1,396,696; Canadian Patent No. 800,958, JP-A-4-204640, JP-A-4-271341, JP-A-4-333043 and JP-A-5-303157; *J. Chem. Soc. Commun.*, 635 (1980); ibid. 1102

(1979); ibid. 645 (1979); *J. Chem. Soc. Perkin. Trans.*, 1,2191 (1980); S. Patai (compiler), *The Chemistry of Organic Selenium and Tellurium Compounds*, Vol. 1 (1986); and ibid. Vol. 2 (1987). In particular, the compounds represented by formulae (II), (III) and (IV) in JP-A-5-323284 are preferred.

The amounts of selenium and tellurium sensitizers for use in the present invention, though they depend on the conditions under which the silver halide grains are ripened chemically, are generally from $10^{-8}$ to $10^{-2}$ mol, preferably from $10^{-7}$ to $10^{-3}$ mol, per mol of silver halide. The chemical sensitization, although the present invention does not impose any particular restriction thereon, is generally carried out under conditions such that the pH is from 5 to 8, the pAg is from 6 to 11, preferably from 7 to 10, and the temperature is from 40° to 95° C., preferably from 45° to 85° C.

Examples of noble metal sensitizers for use in the present invention include gold, platinum, palladium and iridium. In particular, gold sensitizers are preferred. Suitable examples of such gold sensitizers include chloroauric acid, potassium chloroaurate, potassium aurithiocyanate and auric sulfide. These gold sensitizers can be used in an amount of $10^{-7}$ to $10^{-2}$ mol per mol of silver halide.

In a process of producing silver halide emulsion grains used in the present invention or allowing the produced grains to ripen physically a cadmium salt, zinc sulfite, a lead salt, and a thallium salt may be present.

Further, reduction sensitization can be adopted in the present invention. Examples of such reduction sensitizer include stannous salts, amines, formamidinesulfinic acid and silane compounds.

To the silver halide emulsions used in the present invention, thiosulfonate compounds may be added according to the method described in European Patent (EP) No. 293,917.

The present photographic material may contain only one kind of silver halide emulsion or two or more kinds of silver halide emulsions (differing in average grain size, halide composition, crystal habit or chemical sensitization condition).

In the present invention, the silver halide emulsion particularly suitable for a light-sensitive material for dot-to-dot working contains silver halide comprising silver chloride of 90 mol % or more, preferably 95 mol % or more, or silver bromochloride or silver bromoiodochloride containing silver bromide of from 0 to 10 mol %. If the proportion of silver bromide or silver iodide increases, it is not preferred because the safe light safety in an illuminated room is deteriorated, or the γ value is lowered.

Furthermore, the silver halide emulsion suitable for a light-sensitive material for dot-to-dot working preferably contains a transition metal complex. Examples of the transition metal include Rh, Ru, Re, Os, Ir and Cr.

Examples of the ligand thereof include a nitrosyl or thionitrosyl ligand, a halogenated ligand (e.g., fluoride, chloride, bromide, iodide), a cyanine ligan, a cyanate ligand, a thiocyanate ligand, a selenocyanate ligand, a tellurocyanate ligand, an acid ligand and an aquo ligand. When the aquo ligand exists, the number of the aquo ligand(s) is preferably one or two.

When the rhodium atom is incorporated, it is added in any form such as a monosalt or a complex salt during the grain formation.

Examples of the rhodium salt include rhodium chloride, rhodium dichloride, rhodium trichloride, and ammonium hexachlororhodium acid. Preferred are a water-soluble halide complex compound of tertiary rhodium such as hexachlororhodium (III) acid and salts thereof (e.g., ammonium salt, sodium salt, potassium salt).

The added amount of the water-soluble rhodium salt is from $1.0\times10^{-6}$ to $1.0\times10^{-3}$ mol, preferably from $1.0\times10^{-5}$ to $1.0\times10^{-3}$ mol, and particularly preferably from $5.0\times10^{-5}$ to $5.0\times10^{-4}$ mol, per mol of silver halide.

The following transition metal complexes are also preferably used.

1. $[Ru(NO)Cl_5]^{-2}$
2. $[Ru(NO)_2Cl_4]^{-1}$
3. $[Ru(NO)(H_2O)Cl_4]^{-1}$
4. $[Ru(NO)Cl_5]^{-2}$
5. $[Rh(NO)Cl_5]^{-2}$
6. $[Re(NO)CN_5]^{-2}$
7. $[Re(NO)ClCN_4]^{-2}$
8. $[Rh(NO)_2Cl_4]^{-1}$
9. $[Rh(NO)(H_2O)Cl_4]^{-1}$
10. $[Ru(NO)CN_5]^{-2}$
11. $[Ru(NO)Br_5]^{-2}$
12. $[Rh(NS)Cl_5]^{-2}$
13. $[Os(NO)Cl_5]^{-2}$
14. $[Cr(NO)Cl_5]^{-3}$
15. $[Re(NO)Cl_5]^{-1}$
16. $[Os(NS)Cl_4(TeCN)]^{-2}$
17. $[Ru(NS)I_5]^{-2}$
18. $[Re(NS)_2Cl_4(SeCN)]^{-2}$
19. $[Os(NS)Cl(SCN)_4]^{-2}$
20. $[Ir(NO)Cl_5]^{-2}$

Spectral sensitizing dyes for use in the present invention are not particularly limited.

The amount added of the sensitizing dyes is, though depending on the shape and the size of silver halide grains, from $4\times10^{-6}$ to $8\times10^{-3}$ mol per mol of silver halide. For example, if the size of silver halide grains is from 0.2 to 1.3 μm, the amount added of the sensitizing dyes is preferably from $2\times10^{-7}$ to $3.5\times10^{-6}$ mol, particularly preferably from $6.5\times10^{-7}$ to $2.0\times10^{-6}$mol, per $m^2$ of surface area of silver halide grains.

The light-sensitive silver halide emulsions for use in the present invention may be spectrally sensitized by sensitizing dyes to extend their sensitivities to blue rays of relatively long wavelengths, green rays, red rays or infrared rays. Examples of the sensitizing dyes include cyanine dyes, merocyanine dyes, complex cyanine dyes, complex merocyanine dyes, holopolar cyanine dyes, styryl dyes, hemicyanine dyes, oxonol dyes and hemioxonol dyes.

The sensitizing dyes for use in the present invention include those described in *Research Disclosure*, Item 17643, IV-A (December 1978, p. 23); ibid., Item 1831, X (August 1978, p. 437) and the references cited in these literatures.

In special cases where various type of scanners are used for exposure, it is advantageous to choose sensitizing dyes which can impart spectral sensitivities suited for spectral characteristics of the light source of the scanner used.

For instance, the sensitizing dyes are selected from (A) the simple merocyanines disclosed in JP-A-60-162247, JP-A-2-48653, U.S. Pat. No. 2,161,331, West German Patent No. 936,071 and JP-A-5-11382 for an argon laser light source, (B) the trinuclear cyanine dyes disclosed in JP-A-50-62425, JP-A-54-18726 and JP-A-59-102229 and the sensitizing dyes represented by formula (I) in JP-A-6-

75322 for an He-Ne laser light source, (C) the thiacarbocyanines disclosed in JP-B-48-42172, JP-B-51-9609, JP-B-55-39818, JP-A-62-284343 and JP-A-2-105135 for an LED or red semiconductor laser light source, (D) the tricarbocyanines disclosed in JP-A-59-191032 and JP-A-60-80841 and the 4-quinoline nucleus-containing dicarbocyanines represented by formula (IIIa) or (IIIb) in JP-A-59-192242 and JP-A-3-67242 for an infrared semiconductor layer light source, and (E) the sensitizing dyes represented by formula (IV) in JP-A-7-36139 for a white light source such as camera photographing.

Those sensitizing dyes may be used individually or in combination. Combinations of sensitizing dyes are often used for the purpose of supersensitization. Materials which can exhibit a supersensitizing effect in combination with sensitizing dyes although they themselves do not spectrally sensitize silver halide emulsions or do not absorb light in the visible region may be incorporated in the emulsions.

Useful sensitizing dyes, supersensitizing combinations of dyes, and materials capable of exhibiting a supersensitizing effect are described in, e.g., *Research Disclosure,* Vol. 176, Item 17643, IV-J (December 1978, p. 23).

Next, the developer for use in the present invention is explained below.

In the present invention, the developer for developing the photographic material may contain additives generally used (e.g., developing agent, alkali agent, pH buffer, preserving agent, chelating agent). The development may be processed according to known methods. The developer may be selected from known developers.

The developer for use in the present invention does not substantially contain a dihydroxybenzene developing agent as discussed above, preferably contains no dihydroxybenzene developing agent, and contains as a main developing agent (1) at least one compound selected from ascorbic acid, erythorbic acid (geometric isomer of ascorbic acid) and alkali metal salts thereof and (2) a compound represented by formula (II) in combination.

Furthermore, the developer according to the present invention contains an auxiliary developing agent exhibiting a superadditive property to the above-described developing agents (1) and (2). The auxiliary developing agent is preferably a 1-phenyl-3-pyrazolidone auxiliary developing agent and/or a p-aminophenol auxiliary developing agent.

The developing agent (1) selected from ascorbic acid, erythorbic acid and alkali metal salts thereof is preferably used in an amount of from $5\times10^{-3}$ to 1 mol, more preferably from $10^{-2}$ to 0.5 mol, per mol of developer.

The compound represented by formula (II) will be explained in detail below.

In formula (II), the aryl group represented by X is an aryl group having from 6 to 10 carbon atoms (e.g., phenyl, naphthyl), which may be substituted with one or more substituents. Example of the substituents include an alkyl group, an alkenyl group, an aryl group, a halogen atom, a nitro group, a hydroxyl group, an alkoxy group, an aryloxy group, an alkylthio group, an arylthio group, an acyloxy group, an amino group, an alkylamino group, a carbonamido group, a sulfonamido group, a ureido group, an acyl group, an oxycarbonyl group, a carbamoyl group, a sulfinyloxy group, a carboxyl group (containing a salt thereof), a sulfo group (containing a salt thereof) and a hydroxyamino group. Preferred examples of the aryl group include phenyl, p-methylphenyl, anisyl, p-carboxyphenyl and p-sulfonylphenyl.

The heterocyclic group represented by formula X is a 5-or 6-membered heterocyclic group containing a carbon atom, a nitrogen atom, an oxygen atom or a sulfur atom, and examples thereof include a furyl group, a benzofuryl group, a pyranyl group, a pyrolyl group, an imidazolyl group, a pyrazolyl group, a triazolyl group, a pyridyl group, a pyrimidyl group, a pyridazyl group, a thienyl group and an isothiazolyl group. These groups have one or more substituents, and examples thereof include the substituents enumerated with regard to the above-described aryl group represented by X. Preferable examples of the heterocyclic group include furyl, 5-methylfuryl, benzofuryl, pyridyl, 5-chloropyridyl, 3-carboxypyridyl, 5-sulfonylpyridyl and 1-phenyltriazolyl.

In formula (A), $R_4$, $R_5$ and $R_6$ are the same or different and each represents a hydrogen atom or a substituent other than a hydroxyl group. Examples of the substituent represented by $R_4$, $R_5$ and $R_6$ include an alkyl group, an aryl group, an alkoxy group, an aryloxy group, an alkylthio group, an arylthio group, an acyloxy group, an amino group, an alkylamino group, a carbonamido group, a sulfonamido group, a ureido group, an oxycarbonyl group, a carbamoyl group, a sulfinyloxy group, a carboxyl group (containing a salt thereof) and a sulfo group (containing a salt thereof) These groups may be further substituted with other substituent(s), and examples thereof include the substituents enumerated with regard to the above-described aryl group represented by X.

The alkyl group represented by $R_4$, $R_5$ or $R_6$ is preferably a straight-chain, branched or cyclic alkyl group having from 1 to 16, more preferably from 1 to 6, carbon atoms, which may substituted with one or more substituents, such as methyl, ethyl, propyl, isopropyl, butyl, t-butyl, cyclohexyl, benzyl, hydroxymethyl, methoxymethyl, phenoxymethyl, methylthiomethyl, phenylthiomethyl, acetoxymethyl, 1,2-diacetoxymethyl, 1,2,3-triacetoxypropyl, aminomethyl, dimethylaminomethyl, acetamidomethyl, methanesulfonylamidomethyl, ureidomethyl, methoxycarbonylmethyl, carbamoylmethyl, carboxymethyl and sulfonylmetnyl. Examples of the substituents include the substituents enumerated with regard to the above-described aryl group represented by X.

The aryl group represented by $R_4$, $R_5$ or $R_6$ is preferably an aryl group having from 6 to 10 carbon atoms, which may be substituted with one or more substituents, such as phenyl, naphthyl and p-methylphenyl. Examples of the substituents include the substituents enumerated with regard to the above-described aryl group represented by X.

The alkoxy group represented by $R_4$, $R_5$ or $R_6$ is preferably an alkoxy group having from 1 to 19, more preferably from 1 to 8, carbon atoms, which may be substituted with one or more substituents, such as methoxy, ethoxy, propoxy, butoxy, pentyloxy, hexyloxy, octyloxy and 2-methoxyethoxy. Examples of the substituents include the substituents enumerated with regard to the above-described aryl group represented by X.

The aryloxy group represented by $R_4$, $R_5$ or $R_6$ is preferably an aryloxy group having from 6 to 10 carbon atoms, which may be substituted with one or more substituents, such as phenoxy, o-hydroxyphenoxy, o-carboxyphenoxy, and o-sulfonylphenoxy. Examples of the substituents include the substituents enumerated with regard to the above-described aryl group represented by X.

The alkylthio group represented by $R_4$, $R_5$ or $R_6$ is preferably an alkylthio group having from 1 to 16, more preferably from 1 to 8, carbon atoms, which may be substituted with one or more substituents, such as methythio and octylthio. Examples of the substituents include the substituents enumerated with regard to the above-described aryl group represented by X.

The arylthio group represented by $R_4$, $R_5$ or $R_6$ is preferably an arylthio group having from 6 to 10 carbon atoms, which may be substituted with one or more substituents, such as phenylthio and 4-hydroxyphenylthio. Examples of the substituents include the substituents enumerated with regard to the above-described aryl group represented by X.

The acyloxy group represented by $R_4$, $R_5$ or $R_6$ is preferably an alkylthio group having from 1 to 17, more preferably from 1 to 8, carbon atoms, which may be substituted with one or more substituents, such as acetoxy, propanoyloxy, butanoyloxy, octanoyloxy, carboxyacetoxy and 3-sulfonyl-propanoyloxy. Examples of the substituents include the substituents enumerated with regard to the above-described aryl group represented by X.

The alkylamino group represented by $R_4$, $R_5$ or $R_6$ is preferably an alkylamino group having from 1 to 6 carbon atoms, such as dimethylamino and diethylamino. The carbonamido group represented by $R_4$, $R_5$ or $R_6$ is preferably a carbonamido group having from 1 to 6 carbon atoms, such as acetamido and propionamido. The sulfonamido group represented by $R_4$, $R_5$ or $R_6$ is preferably a sulfonamido group having from 1 to 6 carbon atoms, such as methanesulfonamido. The ureido group represented by $R_4$, $R_5$ or $R_6$ is preferably a ureido group having from 1 to 6 carbon atoms, such as ureido and methylureido. The oxycarbonyl group represented by $R_4$, $R_5$ or $R_6$ is preferably an oxycarbonyl group having from 1 to 6 carbon atoms, such as methoxycarbonyl and ethoxycarbonyl. The carbamoyl group represented by $R_4$, $R_5$ or $R_6$ is preferably a carbamoyl group having from 1 to 6 carbon atoms, such as carbamoyl and N, N-dimethylcarbamoyl. The sulfinyloxy group represented by $R_4$, $R_5$ or $R_6$ is preferably a sulfinyloxy group having from 1 to 6 carbon atoms, such as methanesulfinyloxy. These groups may be further substituted with one or more substituents. Examples of the substituents include the substituents enumerated with regard to the above-described aryl group represented by X.

$R_4$, $R_5$ and $R_6$ are each preferably a hydrogen atom, an alkyl group, an alkoxy group, an aryloxy group, an alkylthio group, an acyloxy group, an oxycarbonyl group or a sulfinyloxy group.

Among compounds represented by formula (II), compounds represented by the following formula (B) are more preferable:

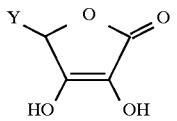

(B)

wherein Y represents a hydrogen atom or a substituent represented by the following formula (C):

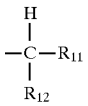

(C)

wherein $R_{11}$ and $R_{12}$ are the same or different and each represents a hydrogen atom, an alkyl group, an alkoxy group, an acyloxy group or an oxycarbonyl group.

In formula (C), in preferred combinations of $R_{11}$and $R_{12}$, $R_{11}$ represents a hydrogen atom, an alkoxy group or an acyloxy group, and $R_{12}$ represents a hydrogen atom, an alkyl group or an oxycarbonyl group.

In these combinations, the alkyl group represented by $R_{12}$ may be substituted with one or more substituents, and is preferably an alkyl group substituted with an alkoxy group or an acyloxy group, which may be further substituted.

More preferably, $R_{11}$ is an alkoxy group or an acyloxy group; and $R_{12}$ is an alkyl group substituted with an alkoxy group or an acyloxy group. $R_{12}$ is particularly preferably an alkyl group having from 1 to 6 carbon atom (most preferably, an ethyl group) substituted with an alkoxy or acyloxy group having from 1 to 8 carbon atoms. These groups may be further substituted with one or more substituents, and examples thereof include the substituents enumerated with regard to the above-described aryl group represented by X.

Among compounds represented by formula (B), compounds represented by the following formula (D) are more preferable:

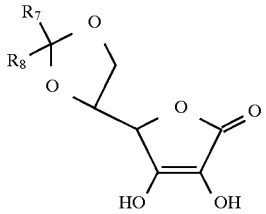

(D)

wherein $R_7$ and $R_8$ are the same or different and each represents a hydrogen atom, an alkyl group, an aryl group or an alkenyl group, and the alkyl groups represented by $R_7$ and $R_8$ may bonded to form a ring structure. The alkyl, aryl and alkenyl groups represented by $R_7$ or $R_8$ may be substituted with one or more substituents, and examples of the substituents include an alkyl group, an alkenyl group, an aryl group, a halogen atom, a nitro group, a hydroxyl group, an alkoxy group, an acyl group, a carboxyl group (containing a salt thereof), a sulfo group (containing a salt thereof) and a hydroxyamino group.

$R_7$ and $R_8$ are each preferably a hydrogen atom, an alkyl group having from 1 to 7 carbon atoms, an aryl group having from 6 to 10 carbon atoms, an alkenyl group having from 2 to 7 carbon atom, more preferably a hydrogen atom, an alkyl group having from 1 to 7 carbon atoms, or an aryl group having from 6 to 10 carbon atoms, and most preferably a hydrogen atom or an alkyl group having from 1 to 7 carbon atoms, and the alkyl groups represented by $R_7$ and $R_8$ are bonded with each other to form a ring structure. Preferably, at least one of $R_7$ and $R_8$ is a substituent other than a hydrogen atom. These groups may be substituted with one or more substituents, and examples thereof include the substituents enumerated with regard to formula (D). Specific examples thereof include a hydrogen atom, a methyl group, an ethyl group, a propyl group, a butyl group, a phenyl group, a chloromethyl group, a methoxymethyl group, a 2-methoxyethyl group, a 1-hydroxyamino-1-methylmethyl group, a 2-carboxyethyl group, and a cyclopentyl ring or a cyclohexyl ring formed by bonding the alkyl groups represented by $R_7$ and $R_8$ with each other, which each may be further substituted.

The compounds represented by formula (II) are described in the form of enol structure; however, they are practically the same as compounds having a keto structure obtained by isomerizing the compounds having an enol structure. Accordingly, the compounds of which hydrogen atom is isomerized should be within the scope of the present invention.

Specific examples of the compounds represented by formula (II) are shown below; however, the present invention should not be construed as being limited thereto.

B-1
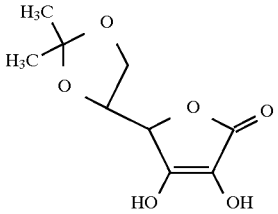
B-2
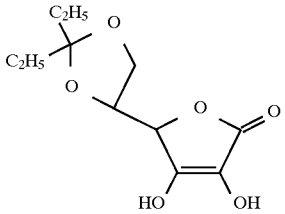
B-3
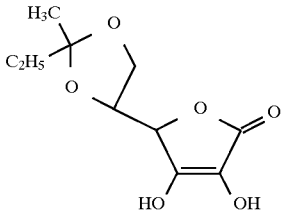
B-4
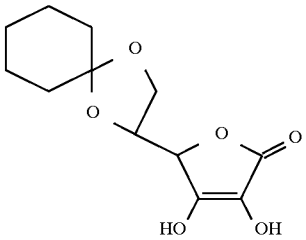
B-5
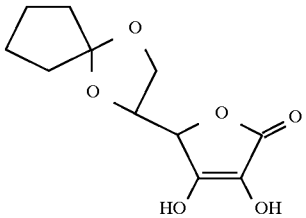
B-6
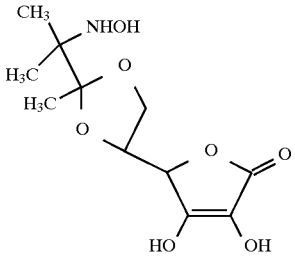
B-7
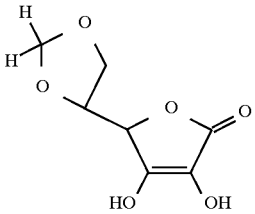
-continued
B-8
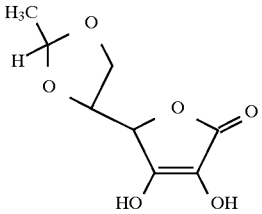
B-9
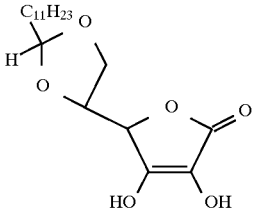
B-10
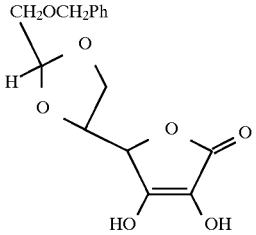
B-11
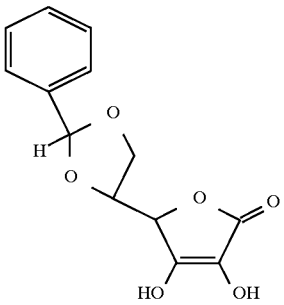
B-12
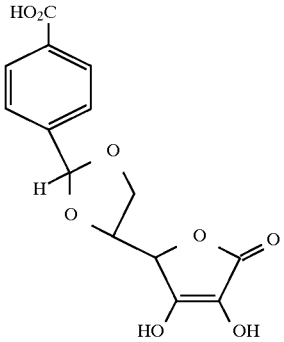
B-13
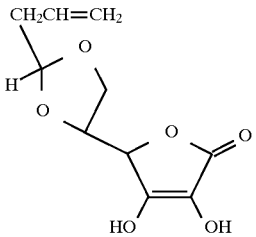

-continued
B-14
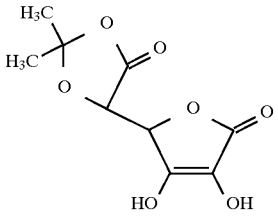
B-15
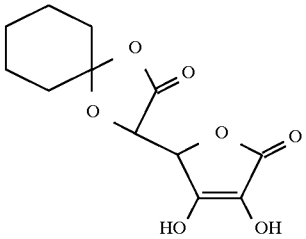
B-16
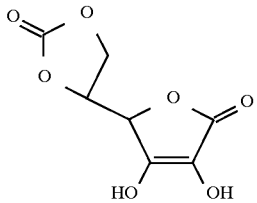
B-17
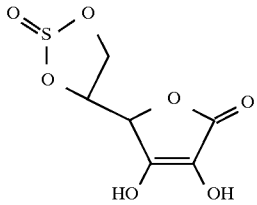
B-18
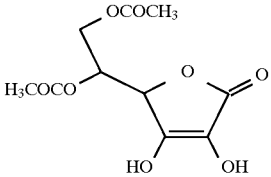
B-19
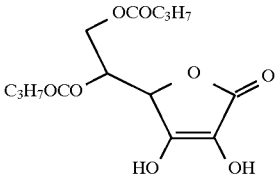
B-20
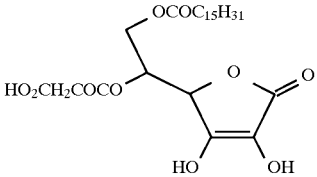
B-21
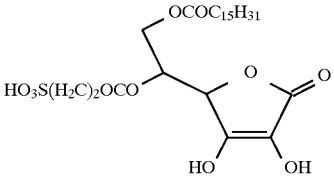
-continued
B-22
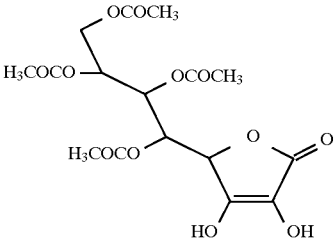
B-23
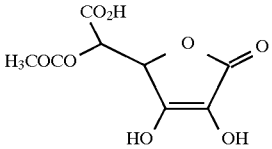
B-24
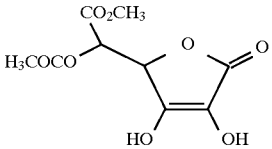
B-25
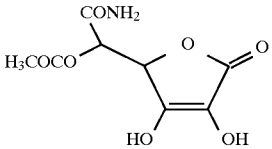
B-26
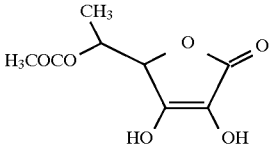
B-27
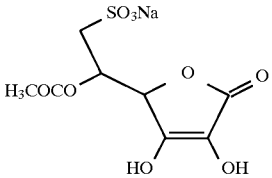
B-28
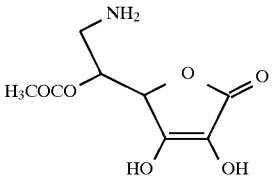
B-29
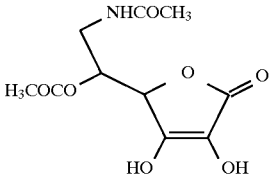
B-30
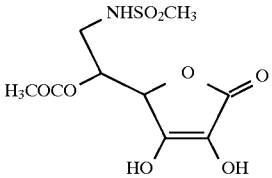

-continued
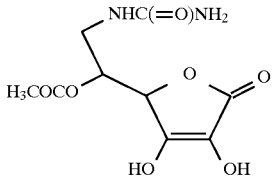
B-31
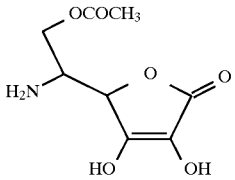
B-32
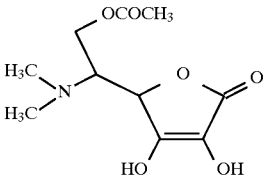
B-33
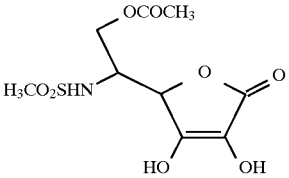
B-34
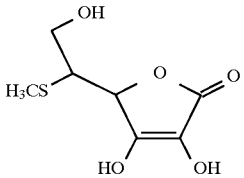
B-35
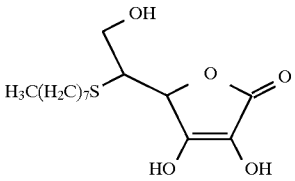
B-36
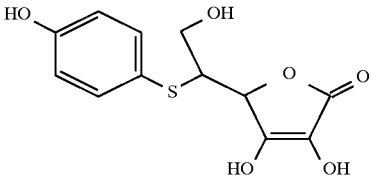
B-37
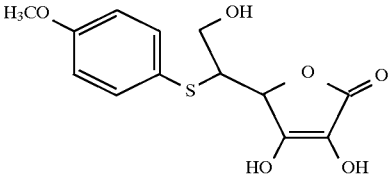
B-38
-continued
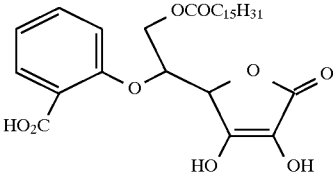
B-39
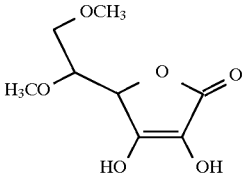
B-40
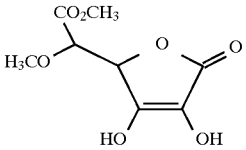
B-41
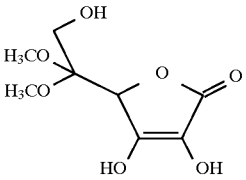
B-42
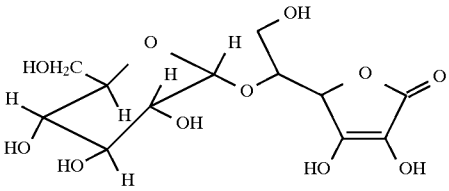
B-43
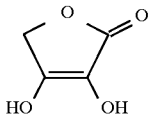
B-44
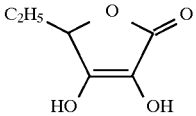
B-45
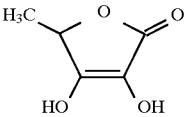
B-46
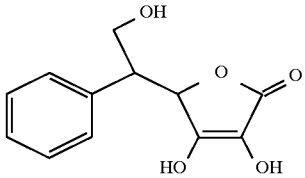
B-47

-continued

B-48

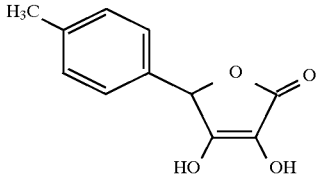

B-49

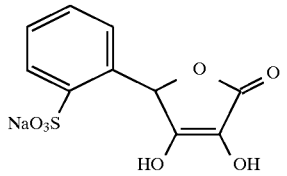

B-50

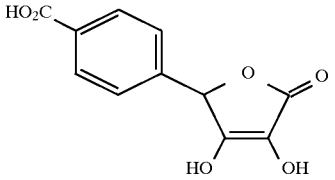

B-51

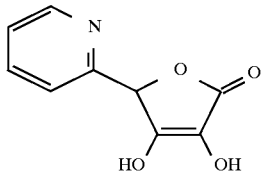

B-52

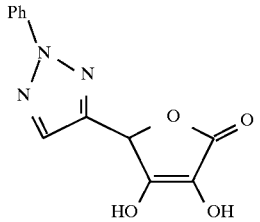

B-53

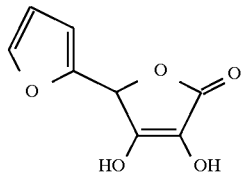

The compound represented by formula (II) can be synthesized according to usual synthesis methods as described in E. S. H. EL. Ashry, A. Mousaad, and N. Rashed, *Advances in Heterocyclic Chemistry*, vol.53, p.233–302, JP-A-64-45383, JP-A-2-288872, JP-A-4-29985, JP-A-4-364182 and JP-A-5-112594. The compound represented by formula (II) is used in an amount of from $5\times10^{-3}$ to 1 mol, preferably from $10^{-2}$ to 0.5 mol, per liter of the developer.

Examples of the 1-phenyl-3-pyrazolidone and derivatives thereof as an auxiliary developing agent include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, and 1-p-tolyl-4-methyl-4-hydroxydimethyl-3-pyrazolidone.

Furthermore, examples of the p-aminophenol and derivatives thereof as an auxiliary developing agent include N-methyl-p-aminophenol, p-aminophenol, N-(β-hydroxyethyl)-p-aminophenol, N-(4-hydroxyphenyl) glycine, 2-methyl-p-aminophenol, and p-benzylaminophenol. Among these, N-methyl-p-aminophenol is preferred.

When the developing agent and the auxiliary developing agent such as 1-phenyl-3-pyrazolidones and p-aminophenols are used in combination, the auxiliary developing agent is used in an amount of from $10^{-3}$ to 0.1 mol, preferably from $10^{-3}$ to 0.06 mol, per liter of the developer.

The expression "containing no dihydroxybenzenes developing agent" as used in the present invention means that the concentration of dihydroxybenzenes in the developer is negligible, compared with those of the compound represented by formula (II) and the foregoing auxiliary developing agents (for example, $5\times10^{-4}$ mol/l or less). The developer of the present invention preferably contains no dihydroxybenzene.

To the developer of the present invention, there may be added sulfites as preservatives, such as sodium sulfite, potassium sulfite, lithium sulfite, sodium hydrogen sulfite, potassium metabisulfite and formaldehyde sodium bisulfite. The sulfites are used in an amount of from 0.01 mol or more per liter of the developer. However, the addition amount thereof should be minimized so far as it can satisfy the need. This is because the addition thereof in a large amount causes the dissolution of silver halide emulsion grains to generate silver stain, and further it is responsible for raising COD (chemical oxygen demand).

Water-soluble inorganic alkali metal salts (e.g., sodium hydroxide, potassium hydroxide, sodium carbonate, potassium carbonate) which are generally used may be used as an alkali agent to adjust a pH.

Examples of the additives added to the developer of the present invention include a development inhibitior (e.g., sodium bromide, potassium bromide), an organic solvent (e.g., ethylene glycol, diethylene glycol, triethylene glycol, dimethylformamide), a development accelerator (e.g., alkanolamine such as diethanolamine and triethanolamine, imidazol, derivatives thereof), and an antifoggant or a black pepper (black spot) inhibitor (e.g., mercapto compound, indazole compound, benzotriazole compound, benzimidazole compound). Specific examples include 5-nitroindazole, 5-p-nitrobenzoylaminoindazole, 1-methyl-5-nitroindazole, 6-nitroindazole, 3-methyl-5-nitroindazole, 5-nitrobenzimidazole, 2-isopropyl-5-nitrobenzimidazole, 5-nitrobenzotriazole, sodium 4-[(2-mercapto-1,3,4-thiadiazol-2-yl)thio]butanesulfonate, 5-amino-1,3,4-thiadiazole-2-thiol, methylbenzotriazole, 5-methylbenzotriazole and 2-mercaptobenzotriazole. The addition amount of the additives is from 0.01 to 10 mmol, more preferably from 0.05 to 2 mmol, per liter of the developer.

Further, various kinds of organic and inorganic chelating agents can be used in combination in the developing solution of the present invention. Examples of the inorganic chelating agents include sodium tetrapolyphosphate and sodium hexametaphosphate.

Examples of the organic chelating agents include organic carboxylic acid, aminopolycarboxylic acid, organic phosphonic acid, aminophosphonic acid, and organic phosphonocarboxylic acid.

Examples of the organic carboxylic acids include acrylic acid, oxalic acid, malonic acid, succinic acid, glutaric acid, adipic acid, pimelic acid, suberic acid, acielaidic acid, sebacic acid, nonanedicarboxylic acid, decanedicarboxylic acid, undecanedicarboxylic acid, maleic acid, itaconic acid, malic acid, citric acid, and tartaric acid.

Examples of the aminopolycarboxylic acids include iminodiacetic acid, nitrilotriacetic acid, nitrilotripropionic acid, ethylenediaminemonohydroxyethyltriacetic acid, ethylenediaminetetraacetic acid, glycol ether tetraacetic acid, 1,2-diaminopropanetetraacetic acid, diethylenetriaminepentaacetic acid, triethylenetetraminehexaacetic acid, 1,3-diamino-2-propanoltetraacetic acid, glycol ether diaminotetraacetic acid, and compounds disclosed in JP-A-52-25632, JP-A-55-67747, JP-A-57-102624, and JP-B-53-40900.

Examples of the organic phosphonic acids include hydroxyalkylidene-diphosphonic acid disclosed in U.S. Pat. Nos. 3,214,454, 3,794,591 and German Patent Publication No. 2,227,639, and the compounds disclosed in *Research Disclosure*, Vol. 181, Item 18170 (May, 1979).

Examples of the aminophosphonic acids include aminotris(methylenephosphonic acid), ethylenediaminotetramethylenephosphonic acid, aminotrimethylenephosphonic acid, and the compounds disclosed in *Research Disclosure*, No. 18170, JP-A-57-208554, JP-A-54-61125, JP-A-55-29883 and JP-A-56-97347.

Examples of the organic phosphonocarboxylic acids include the compounds disclosed in JP-A-52-102726, JP-A-53-42730, JP-A-54-121127, JP-A-55-4024, JP-A-55-4025, JP-A-55- 126241, JP-A-55-65955, JP-A-55-65956 and *Research Disclosure*, No. 18170.

These chelating agents may be used in the form of alkali metal salts or ammonium salts. The addition amount of these chelating agents is preferably from $1\times10^{-4}$ to $1\times10^{-1}$ mol, more preferably from $1\times10^{-3}$ to $1\times10^{-2}$ mol, per liter of the developer.

Furthermore, the developer for use in the present invention can contain the compounds disclosed in JP-A-56-24347, JP-B-56-46585, JP-B-62-2849, and JP-A-4-362942 as a silver stain inhibitor.

Also, the developer for use in the present invention can contain the compounds disclosed in JP-A-62-212651 as a development unevenness inhibitor, and the compounds disclosed in JP-A-61-267759 as a dissolving aid.

Moreover, the developer may contain a color toning agent, a surfactant, an antifoaming agent, and a hardener, if needed.

The developer for use in the present invention may contain carbonates, boric acids such as boric acid, borax, methaboric acid, potassium boric acid as disclosed in JP-A-62-186259, saccharides (e.g., saccharose) as disclosed in JP-60-93433, oximes (e.g., acetoxime), phenols (e.g., 5-sulfo-salicylic acid), tertiary phosphates (e.g., sodium tertiary phosphate, potassium tertiary phosphate) or aluminum salts (e.g., sodium salt) as a buffer. The carbonates and borates are preferred as a buffer.

The developer for use in the present invention preferably contains carbonate in an amount of 0.5 mol/l or more, and more preferably from 0.5 to 1.5 mol/l.

The developer for use in the present invention preferably has a pH of from 9.5 to 11.0, and more preferably from 9.8 to 10.7.

The development processing temperature and the development processing time are related reciprocally and determined in relationship with the total processing time, and generally the processing temperature is from about 20° to 50° C., preferably from 25° to 45° C., and the processing time is from 5 seconds to 2 minutes, preferably from 7 seconds to one minute and 30 seconds.

If $m^2$ of a silver halide black-and-white photographic material is processed, the replenishment rate of the developing solution is 500 ml or less and preferably 350 ml or less.

The salt component contained in the developer is preferably a potassium salt to concentrate the developer.

The fixing solution for use in the fixing step in the present invention is an aqueous solution containing sodium thiosulfate and ammonium thiosulfate, and if needed, tartaric acid, citric acid, gluconic acid, boric acid, iminodiacetic acid, 5-sulfosalicylic acid, glucohepatnic acid, Tiron (disodium salt of 1,2-dihydroxybenzene-3,5-disulfonic acid), ethylenediamine tertaacetic acid, diethylenetriamine pentaacetic acid, nitrilo triacetic acid, and salts thereof. However, it is preferred that the boric acid is not contained in view of the environmental preservation.

Examples of the fixing agent in the fixing solution for use in the present invention include sodium thiosulfate and ammonium thiosulfate. The sodium thiosulfate is preferred in view of the fixing velocity and the sodium thioammonium is preferred in view of the environmental preservation. The amount added of the fixing agent is not particularly limited, but is generally from about 0.1 to 2 mol/l, and particularly preferably from 0.2 to 1.5 mol/l.

The fixing solution can include, if needed, a hardening agent (e.g., water-soluble aluminum compound), a preservative (e.g., sulfite, bisulfite), a pH buffer (e.g., acetic acid), a pH adjustor (e.g., ammonia, sulfuric acid), a chelating agent a surfactant, a wetting agent, and a fixing accelerator.

Examples of the surfactant include an anionic surfactant (e.g., sulfated product, sulfonated product), a polyethylene surfactant, and amphoteric surfactants disclosed in JP-A-57-6840, and known defoaming agents can also be used. Examples of the wetting agent include alkanolamine and alkylene glycol. Examples of the fixing accelerator include thiourea derivatives disclosed in JP-B-45-35754, JP-B-58-122535 and JP-B-58-122536, alcohol having a triple bond in the molecule, thioether compounds disclosed in U.S. Pat. No. 4,126,459, mesoionic compounds disclosed in JP-A-4-229860, and compounds disclosed in JP-A-2-44355.

Examples of the pH buffer for use in the fixing solution include an organic acid such as acetic acid, malic acid, succinic acid, tartaric acid, citric acid, maleic acid, glycol acid and adipic acid, an inorganic acid such as boric acid, phosphate and sulfite. Among these, preferred are acetic acid, tartaric acid, and sulfite.

The pH buffer is used for inhibiting the pH increase of the fixing solution by incorporation of the developer. The pH buffer is used in an amount of from 0.01 to 1.0 mol/l, preferably from 0.02 to 0.6 mol/l.

The pH of the fixing solution is preferably from 4.0 to 6.5, more preferably from 4.5 to 6.0 mol/l.

As a dye dissolution accelerator, the compounds disclosed in JP-A-64-4739 may be used.

As a hardener in the fixing solution for use in the present invention, water-soluble aluminum salts and chromium salts may be used. The water-soluble ammonium salt is preferred and examples thereof include aluminum chloride, aluminum sulfate and potassium alum. The amount added of the pH buffer is preferably from 0.01 to 0.2 mol, more preferably from 0.03 to 0.08 mol, per liter of the fixing solution.

The fixing temperature is from about 20° to 50° C., preferably from 25° to 45° C.; and the fixing time is from 5 seconds to one minute, preferably from 7 to 50 seconds.

The replenishing amount of the fixing solution is preferably 600 ml or less, more preferably 500 ml or less, per $m^2$ of the processed light-sensitive material.

In the photographic processing method of the present invention, the photographic material is processed with washing water or a stabilizing solution after the development and fixation steps, and then dried. It is possible to perform the washing or stabilizing step using washing water or a stabilizing solution at a replenishment rate of at most 3 liter of a replenisher per $m^2$ of silver halide photographic material (including the replenishment rate of zero, namely the washing with stored water). That is, not only economizing water in the washing step but also making a piping work unnecessary in setting up an automatic developing machine becomes possible.

As a method for reduction in replenishment of washing water, the multistage (e.g., two-stage, three-stage) counter current process has been known for a long time. If this process is applied to the present invention, the fixation-processed photographic material is processed as it is brought into contact with successive, more and more cleaned processing solutions, that is, processing solutions less and less contaminated with the fixer. Accordingly, more efficient washing can be carried out.

When the washing step is performed with a small amount of water, it is preferable to use a washing tank equipped with squeeze rollers or crossover rollers, as disclosed in JP-A-63-18350 and JP-A-62-287252. Further, the addition of various kinds of oxidizing agents and the filtration may be supplemented for the purpose of reduction in pollution load. An increase in pollution load is a big problem that the washing with little water faces.

In the present invention also, part or all of the overflow generated from the washing or stabilizing bath by replenishing the bath with the water, which is rendered moldproof by the above-cited means, in proportion as the processing proceeds can be used in the prior step wherein the processing solution having a fixability is used, as described in JP-A-60-235133.

Moreover, a water-soluble surfactant or a defoaming agent may be included in washing water to prevent generation of irregular foaming which is liable to generate when washing is conducted with a small amount of water and/or to prevent components of the processing agents adhered to a squeegee roller from transferring to the processed film.

In addition, dye adsorbents disclosed in JP-A-63-163456 may be included in a washing tank to inhibit contamination by dyes dissolved from photographic materials.

When a photographic material is subjected to stabilizing processing after the washing processing, bath containing compounds disclosed in JP-A-2-201357, JP-A-2-132435, JP-A-1-102553 and JP-A-46-44446 may be used as a final bath. This stabilizing bath may contain, if needed, ammonium compounds, metal compounds such as Bi and Al, brightening agents, various kinds of chelating agents, film pH adjustors, hardening agents, sterilizers, antimold agents, alkanolamines, and surfactants. Tap water, deionized water, and water sterilized by a halogen, ultraviolet sterilizing lamp or various oxidizing agents (e.g., ozone, hydrogen peroxide, chlorate) or tap water containing the compounds disclosed in JP-A-4-39652 and JP-A-5-241309 are preferably used as washing water in a washing step or a stabilizing step.

The temperature and time of the washing and stabilizing bath processing are preferably from 0° to 50° C. and from 5 seconds and 2 minutes.

When the replenishing amount is lowered, the evaporation and air oxidation of the solution are inhibited by reducing the contact area of the solution and the air of the solution tank. Automatic developing machines of roller conveyance type are described in, e.g., U.S. Pat. Nos. 3,025,779 and 3,545,971, and the present invention refers them to simply as processors of roller conveyance type. A processor of roller conveyance type involves four processes, namely development, fixation, washing and drying processes. Also, it is most advantageous for the present method to follow those four processes, although the present method does not exclude other processes (e.g., stop process). The four processes may contain a stabilizing step in place of the washing step.

The processing solution for use in the present invention may be applied in the form of solid processing agents. The solid processing agents used include powder, tablet, granule, particle or paste agents. Preferred are a form as described in JP-A-61-259921 or a tablet form. The tablet processing agent can be produced by a general process described in, for example, JP-A-51-61837, JP-A-54-155038, JP-A-52-88025, and British Patent No. 1,213,808. The granule processing agent may be produced according to general processes as described in, for example, JP-A-2-109042, JP-A-2-109043, JP-A-3-39735, and JP-A-3-39739. Moreover, the powder processing agent may be produced according to general processes as described in, for example, JP-A-54-133332, British Patent Nos. 725,892 an 729,862, and German Patent No. 3,733,861.

The bulk density of the solid processing agent is preferably from 0.5 to 6.0 g/cm$^3$, and particularly from 1.0 to 5.0 g/cm$^3$, from the viewpoints of the solubility and the effects of the objects of the present invention.

The photographic materials of the present invention are not particularly restricted as to additives, and so various kinds of additives can be used therein. However, those disclosed in the following patent specifications can be preferably added thereto.

| Item | Reference and Passage therein |
|---|---|
| 1) Surfactants | JP-A-2-12236, at page 9, from right upper column, line 7, to right lower column, line 7; and JP-A-2-185424, from page 2, left lower column, line 13, to page 4, right lower column, line 18. |
| 2) Antifoggants | JP-A-2-103536, from page 17, right lower column, line 19, to page 18, right upper column, line 4, and page 18, right lower column, from line 1 to line 5; the thiosulfinic acid compounds disclosed in JP-A-1-237538. |
| 3) Polymer latexes | JP-A-2-103536, page 18, left lower column, from line 6 to line 20. |
| 4) Compounds containing an acidic group | JP-A-2-103536, from page 18, left lower column, line 6, to page 19, left upper column, line 1. |
| 5) Matting agents, Slipping agents, and Plasticizers | JP-A-2-103536, at page 19, from left upper column, line 15, to right upper column, line 15. |
| 6) Hardeners | JP-A-2-103536, at page 18, right upper column, from line 5 to line 17. |
| 7) Dyes | JP-A-2-103536, at page 17, right lower column, from line 1 to line 18; the solid dyes disclosed in JP-A-2-294638 and JP-A-5-11382. |
| 8) Binders | JP-A-2-18542, at page 3, right lower column from line 1 to line 20. |
| 9) Black spot inhibitors (Black pepper inhibitors) | The compounds disclosed in U.S. Pat. 4,956,257 and JP-A-1-118832. |
| 10) Monomethine compounds | The compounds represented by formula (II) in JP-A-2-287532 (especially Exemplified Compounds II-1 to II-26). |
| 11) Dihydroxybenzenes | The compounds disclosed in JP-A-3-39948, from page 11, left upper column to page 12, left lower column, and those disclosed in EP- |

-continued

| Item | Reference and Passage therein |
|---|---|
| | A-452772. |

The present invention will now be illustrated in greater detail by reference to the following examples. However, the invention should not be construed as being limited to these examples.

EXAMPLES

First, how to prepare a silver halide emulsion used in the following examples will be explained.

Emulsion A

An aqueous 0.13M silver nitrate solution and an aqueous halide solution containing $K_2Rh(H_2O)Cl_5$ in an amount corresponding to $1.5\times10^{-7}$ mol per mol of silver, $K_3IrCl_6$ in an amount of $2\times10^{-7}$ mol per mol of silver, 0.04M potassium bromide and 0.09M sodium chloride were added to an aqueous gelatine solution containing sodium chloride and 1,3-dimethyl-2-imidazolidinethione with stirring at 38° C. over a period of 12 minutes according to a double jet method to carry out the nucleating. This gave silver bromochloride particles having an average particle size of 0.14 μm and a silver chloride content of 70 mol %. Subsequently, an aqueous 0.87M silver nitrate solution and an aqueous halide solution containing 0.26M potassium bromide and 0.65M sodium chloride were similarly added according to the double jet method over a period of 20 minutes.

Thereafter, a $1\times10^{-3}$ mol KI solution was added to carry out conversion, and the solution was washed with water by a flocculation method according to the conventional method using a copolymer of isobutene and monosodium maleate as a settling agent. Then, 40 g of gelatine was added per mol of silver to adjust the pH to 6.5 and the pAg to 7.5. Then, 7 mg of sodium benzenesulfonate, 2 mg of sodium benzenefulfinate, 8 mg of chloroauric acid, 200 mg of potassium thiocyanate and 5 mg of sodium thiosulfate were added per mol of silver, the mixture was heated at 60° C. for 45 minutes to subject it to a chemical sensitization. Thereafter, 150 mg of 4-hydroxy-6-methyl-1,3,3a,7-tetrazaindene as a stabilizer and 100 mg of proxel as a preservative were added. The resulting particles were silver iodochlorobromide cubes having an average particle size of 0.25 μm and containing 69.9 mol % of silver chloride (coefficient of variation: 10%).

Emulsion B

An aqueous 0.37M silver nitrate solution and an aqueous halide solution containing $(NH_4)_3RhCl_6$ in an amount corresponding to $1.0\times10^{-7}$ mol per mol of silver in the finished emulsion, $K_3IrCl_6$ in an amount of $2\times10^{-7}$ mol per mol of silver, 0.11M potassium bromide and 0.27M sodium chloride were added to an aqueous gelatine solution containing sodium chloride and 1,3-dimethyl-2-imidazolidinethione with stirring at 45° C. over a period of 12 minutes according to the double jet method to carry out the nucleating. This gave silver chlorobromide particles having an average particle size of 0.20 μm and a silver chloride content of 70 mol %. Subsequently, an aqueous 0.63M silver nitrate solution and an aqueous halide solution containing 0.19M potassium bromide and 0.47M sodium chloride were similarly added according to the double jet method over a period of 20 minutes. Thereafter, a $1\times10^{-3}$ mol KI solution was added per mol of silver to carry out conversion, and the solution was washed with water by a flocculation method according to the conventional method. Then, 40 g of gelatine was added to adjust the pH to 6.5 and the pAg to 7.5. Then, 7 mg of sodium benzenesulfonate, 5 mg of sodium thiosulfate, and 8 mg of chloroauric acid were added, the mixture was heated at 60° C. for 45 minutes to subject it to a chemical sensitization. Thereafter, 150 mg of 4-hydroxy-6-methyl-1,3,3a,7-tetrazaindene as a stabilizer and proxel as a preservative were added. The resulting particles were silver chlorobromide cubes having an average particle size of 0.28 μm and containing 70 mol % of silver chloride (coefficient of variation: 9%).

Emulsion C

With stirring, Liquid 1, Liquid 2 and Liquid 3 described in Table 1, kept at 38° C. and at a pH of 4.5 were added at the same time over a period of 24 minutes to form 0.18 μm particles. Subsequently, Liquid 4 and Liquid 5 were added over a period of 8 minutes, and 0.15 g of potassium iodide was added to finish the formation of particles.

Thereafter, the particles were washed with water by the flocculation method according to the usual method, gelatine was added, and the pH and pAg were adjusted to 5.2 and 7.5, respectively, followed by adding 4 mg of sodium thiosulphate, 2 mg of N,N-dimethylselenourea, 10 mg of chloroauric acid, 4 mg of sodium benzenethiosulfonate, and 1 mg of sodium benzenethiosulfinate to conduct chemical sensitization to reach the optimum sensitivity at 55° C.

Furthermore, 50 mg of 2-methyl-4-hydroxy-1,3,3a,7-tetrazaindene as a stabilizer and an appropriate amount of phenoxy ethanol as a preservative so that the concentration was 100 ppm were added to finally obtain silver iodochlorobromide cubic particles having a silver chloride content of 80 mol % and an average particle size of 0.20 μm (coefficient of variation: 9%).

TABLE 1

| | |
|---|---|
| Liquid 1: | |
| Water | 1 liter |
| Gelatine | 20 g |
| Sodium chloride | 2 g |
| 1,3-Dimethylimidazolidin-2-thion | 20 mg |
| Sodium benzenethiosulfonate | 6 mg |
| Liquid 2: | |
| Water | 600 ml |
| Silver nitrate | 150 g |
| Liquid 3: | |
| Water | 600 ml |
| Sodium chloride | 45 g |
| Potassium bromide | 21 g |
| Potassium hexachloroiridinate (III) (Aqueous 0.001% solution) | 15 ml |
| Ammonium hexabromoiridinate (III) (Aqueous 0.001% solution) | 1.5 ml |
| Liquid 4: | |
| Water | 200 ml |
| Silver nitrate | 50 g |
| Liquid 5: | |
| Water | 200 ml |
| Sodium chloride | 15 g |
| Potassium bromide | 7 g |
| $K_4Fe(CN)_6$ | 30 mg |

Example 1

Onto a polyethylene terephthalate film (150 μm) support having an undercoating layer (0.5 μm) comprising a vinylidene chloride copolymer, layers of UL, EM, ML and PC were applied on this order. The preparation and the applied amount of each layer are shown below.

(UL Layer)

Gelatine (10 g), 50 wt % of polyethylacrylate latex based on gelatine, and 3.5 wt % of compound (a) based on gelatine were added and an amount of water such that the total amount was 250 ml was added to prepare a UL layer, which was applied so that the amount of gelatine was 0.4 g/m$^2$.

(EM Layer)

After the above-mentioned Emulsion A was dissolved with gelatine at 40° C., $3.2\times10^{-4}$ mol/mol Ag of sensitizer (S-1), $2.7\times10^{-4}$ mol/mol Ag of sensitizing dye (S-2), $3.4\times10^{-3}$ mol/mol Ag of KBr, $3.2\times10^{-4}$ mol/mol Ag of compound (b), $7.4\times10^{-4}$ mol/mol Ag of compound (c), $9.7\times10^{-3}$ mol/mol Ag of hydroquinone, $8.0\times10^{-3}$ mol/mol Ag of phosphoric acid, $4.5\times10^{-4}$ mol/mol Ag of (I-38) represented by formula (I), $5.3\times10^{-4}$ mol/mol Ag of (A-12) represented by formula (II), and $3\times^{10-4}$ mol/mol Ag of compound W-1 were added. Further, 15 wt % of polyethyl acrylate, 15 wt % of a latex copolymer (methyl acrylate : sodium 2-acrylamido-2-methylpropane sulfonate:2-acetoacetoxyethyl methacrylate=88:5:7 by weight), and 4 wt % of compound (a) were added all based on gelaine, and the mixture was applied so that the amount of Ag was 3.3 g/m$^2$.

(ML Layer)

To a gelatine solution were added 7 mg/m$^2$ of compound (d), 15 wt % of polyethyl acrylate, and 3.5 wt % of compound (a), all based on gelatine, and the mixture was applied so that the amount of gelatine was 0.5 g/m$^2$.

(PC Layer)

To a gelatine solution were added 40 mg/m$^2$ of an amorphous $SiO_2$ matting agent having an average particle size of 3.5 $\mu$m, 20 mg/m$^2$ of silicone oil, and 5 mg/m$^2$ of compound (e) as an coating aid, and the mixture was applied. The amount of gelatine was 0.3 g/m$^2$.

Additives to Photosensitive Material of Example 1

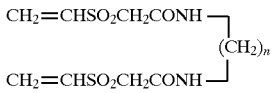

Compound (a)

3:1 mixture of compounds wherein n=2 and wherein n=3

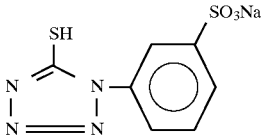

Compound (b)

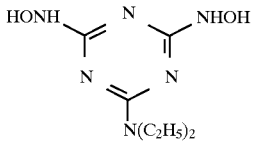

Compound (c)

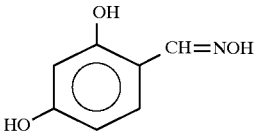

Compound (d)

-continued

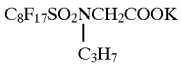

Compound (e)

Sensitizing Dye (S-1)

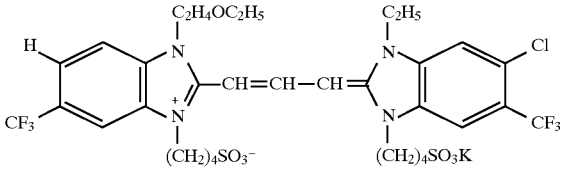

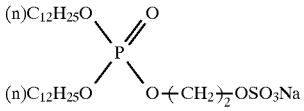

Compound W-1

Sensitizing Dye (S-2)

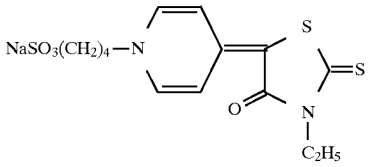

Sensitizing Dye (S-3)

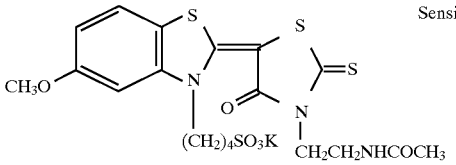

A back layer and a back protective layer having the following formulations were applied:

[Formulation of Back Layer]

| | |
|---|---|
| Gelatine | 3 g/m$^2$ |
| Latex: Polyethyl acrylate | 2 g/m$^2$ |
| Surfactant: Sodium p-dodecylbenzenesulfonate | 40 mg/m$^2$ |

-continued

| | |
|---|---|
| Compound (a) | 110 mg/m$^2$ |
| $SnO_2$/Sb (weight ratio 90/10, average particle size: 0.20 μm) | 200 mg/m$^2$ |
| Dye: | |
| Mixture of Dye (a), Dye (b), and Dye (c) | |
| Dye (a) | 70 mg/m$^2$ |
| Dye (b) | 100 mg/m$^2$ |
| Dye (C) | 50 mg/m$^2$ |

Dye (a)

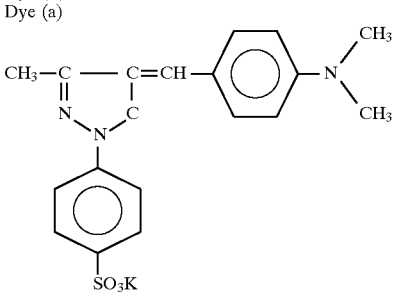

Dye (b)

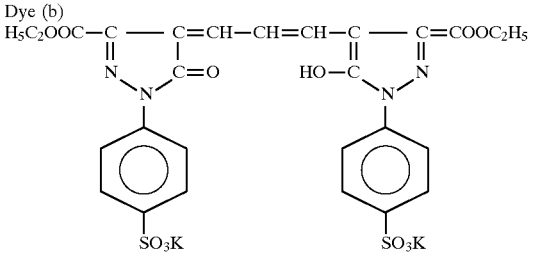

Dye (c)

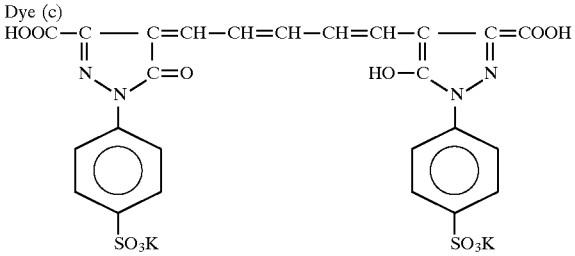

[Back Protective Layer]

| | |
|---|---|
| Gelatine | 0.8 mg/m$^2$ |
| Polymethyl methacrylate fine particle (average particle size: 4.5 μm) | 30 mg/m$^2$ |
| Sodium dihexyl-α-sulfosuccinate | 15 mg/m$^2$ |
| Sodium p-dodecylbenzenesulfonate | 15 mg/m$^2$ |
| Sodium acetate | 40 mg/m$^2$ |

Preparation of Developer

Using formulation as shown in Table 2, Developers, D-1 to D-8 according to the present invention were prepared.

TABLE 2

| | Number of developer and Composition | | | | | | | |
|---|---|---|---|---|---|---|---|---|
| Components of Developer (g) | D-1 | D-2 | D-3 | D-4 | D-5 | D-6 | D-7 | D-8 |
| Potassium hydroxide | 35 | 35 | 35 | 35 | 35 | 35 | 35 | 35 |
| Diethylenetriamine pentaacetic acid | 2.0 | 2.0 | 2.0 | 2.0 | 2.0 | 2.0 | 2.0 | 2.0 |
| Potassium carbonate | 40 | 40 | 40 | 40 | 40 | 40 | 40 | 40 |
| Potassium bromide | 3 | 3 | 3 | 3 | 3 | 3 | 3 | 3 |
| 5-Methylbenzotriazole | 0.08 | 0.08 | 0.08 | 0.08 | 0.08 | 0.08 | 0.08 | 0.08 |
| Sodium 2-mercaptobenzimidazole-5-sulfonate | 0.15 | 0.15 | 0.15 | 0.15 | 0.15 | 0.15 | 0.15 | 0.15 |
| 2,3,5,6,7,8-Hexahydro-2-thioxo-4- | 0.03 | 0.03 | 0.03 | 0.03 | 0.03 | 0.03 | 0.03 | 0.03 |

TABLE 2-continued

| Components of Developer (g) | Number of developer and Composition | | | | | | | |
|---|---|---|---|---|---|---|---|---|
| | D-1 | D-2 | D-3 | D-4 | D-5 | D-6 | D-7 | D-8 |
| (1H)-quinazolinone | | | | | | | | |
| Sodium methabisulfite | 44 | 44 | 44 | 44 | 44 | 44 | 44 | 44 |
| 4-Hydroxymethyl-4-methyl-1-phenyl-3-pyrazolidone | 0.45 | 0.45 | 0.45 | 0.45 | 0.45 | 0.45 | 0.45 | 0.45 |
| Hydroquinone | 23.3 | — | — | — | — | — | — | — |
| Sodium erythorbinate | — | 45.8 | — | 22.9 | — | 22.9 | 22.9 | 22.9 |
| Sodium ascorbinate | — | — | — | — | 18.7 | — | — | — |
| Compound B-18 of the present invention | — | — | — | — | — | 22.5 | — | — |
| Compound B-1 of the present invention | — | — | 45.0 | 22.5 | 22.5 | — | — | — |
| Compound B-8 of the present invention | — | — | — | — | — | — | 22.5 | — |
| Compound B-44 of the present invention | — | — | — | — | — | — | — | 22.5 |
| Water | to 1 liter | | | | | | | |
| pH adjusted to | 10.5 | 10.5 | 10.5 | 10.5 | 10.5 | 10.5 | 10.5 | 10.5 |
| Remarks | Comparison | Comparison | Comparison | Invention | Invention | Invention | Invention | Invention |

The formulation of the fixer used in the present invention is shown below.

| (Formulation of Fixer) | |
|---|---|
| Ammonium thiosulfate | 360 g |
| Ethylenediamine tetraacetate, $2Na.2H_2O$ | 2.3 g |
| Sodium thiosulfate $5H_2O$ | 33.0 g |
| Sodium sulfite | 75.0 g |
| Sodium hydroxide | 37.0 g |
| Glacial acetic acid | 87.0 g |
| Tartaric acid | 8.8 g |
| Sodium gluconate | 6.6 g |
| Aluminum sulfate | 25.0 g |
| Water | to 3 liters |
| pH (adjusted with sulfuric acid or sodium hydroxide) | 4.85 |

(Exposure and development processings)

These samples were exposed with tungsten light of 3,200° K. for 5 seconds through an optical wedge for sensitometry. The exposed samples were developed with a developer shown in Table 2 at 30° C. for 30 seconds, and then were subjected to fixing, water washing and drying processings. These processings were carried out by using an automatic developing machine FG-680A produced by Fuji Photo Film Co., Ltd.

The sensitivity was indicated by a relative value taking an inverted value of an amount of exposure required for obtaining the concentration of 1.5 when being processed with No. 1 in Table 3 as 100. A gamma value as an index for the image contrast was represented by a gradient of a straight chain drawn by connecting a point to give (fog+density of 0.3) and a point to give (fog+density of 0.3) in the characteristic curve. More specifically, $\gamma$=(3.0–0.3)/[log(exposure amount of exposure giving a concentration of 3.0)-log(exposure amount of exposure giving a concentration of 0.3)]

The larger the $\gamma$ value is, the higher contrast photographic property the sample has.

TABLE 3

| Sample No. | Developer No. | Fog | Sensitivity (S1.5) | Gradation | Remarks |
|---|---|---|---|---|---|
| 1 | D-1 | 0.04 | 100 | 23.9 | Comparison |
| 2 | D-2 | 0.04 | 85 | 16.9 | Comparison |
| 3 | D-3 | 0.04 | 112 | 18.6 | Comparison |
| 4 | D-4 | 0.04 | 95 | 22.6 | Invention |
| 5 | D-5 | 0.04 | 96 | 22.8 | Invention |
| 6 | D-6 | 0.04 | 95 | 23.0 | Invention |
| 7 | D-7 | 0.04 | 94 | 22.7 | Invention |
| 8 | D-8 | 0.04 | 96 | 22.3 | Invention |

As is apparent from the results shown in Table 3, high contrast images can be obtained by using two developing agents in combination according to the processing method of the present invention using reductones which are preferable in terms of environment and toxicology. Use of the ascorbic acid or the compound represented by formula (II) used alone as a developing agent cannot provide high contrasty which is equal to that provided by use of a hydroquinone developing agent. Accordingly, the high contrasty provided by the present invention is not an effect of combination, but an unexpected effect.

Example 2

Samples were prepared according to Example 1, except for replacing the formulation of the EM layer of Example 1 with the following formulation.

(EM Layer)

After the above-mentioned Emulsion B was dissolved with gelatine at 40° C., $4.6\times10^{-4}$ mol/mol Ag of sensitizer (the above-mentioned S-3), $1.7\times10^{-4}$ mol/mol Ag of sensitizing dye (S-1), $4.5\times10^{-3}$mol/mol Ag of KBr, $3.1\times10^{-4}$ mol/mol Ag of compound (b), $7.4\times^{10-4}$ mol/mol Ag of compound (c), $2.9\times10^{-2}$ mol/mol Ag of hydroquinone, $2.3\times10^{-3}$ mol/mol Ag of acetic acid, 10 wt % of colloidal silica based on gelatine, $3.4\times10^{-4}$ mol/mol Ag of compound (I-38) represented by formula (I), $4.9\times10^{-4}$ mol/mol Ag of compound (A-12) represented by formulae (III), and $3\times10^{-4}$ mol/mol Ag of compound W-1 were added. Further, 30 wt % of polyethyl acrylate latex polymer and 4 wt % of compound (a) were added both based on gelatine, and the mixture was applied. Compounds (a), (b), (c) were the same as those of Example 1.

TABLE 4

| Components of Developer (g) | Number of developer and Composition | | | | | | | |
|---|---|---|---|---|---|---|---|---|
| | D-9 | D-10 | D-11 | D-12 | D-13 | D-14 | D-15 | D-16 |
| Potassium hydroxide | 35 | 35 | 35 | 35 | 35 | 35 | 35 | 35 |
| Diethylenetriamine pentaacetic acid | 2.0 | 2.0 | 2.0 | 2.0 | 2.0 | 2.0 | 2.0 | 2.0 |
| Potassium carbonate | 40 | 40 | 40 | 40 | 40 | 40 | 40 | 70 |
| Potassium bromide | 3 | 3 | 3 | 3 | 3 | 3 | 3 | 3 |
| 5-Methylbenzotriazole | 0.08 | 0.08 | 0.08 | 0.08 | 0.08 | 0.08 | 0.08 | 0.08 |
| Sodium 2-mercaptobenzimidazole-5-sulfonate | 0.15 | 0.15 | 0.15 | 0.15 | 0.15 | 0.15 | 0.15 | 0.15 |
| 2,3,5,6,7,8-Hexahydro-2-thioxo-4-(1H)-quinazolinone | 0.03 | 0.03 | 0.03 | 0..03 | 0.03 | 0.03 | 0.03 | 0.03 |
| Sodium methabisulfite | 44 | 44 | 44 | 44 | 44 | 44 | 44 | 44 |
| 4-Hydroxymethyl-4-methyl-1-phenyl-3-pyrazolidone | 0.45 | 0.45 | 0.45 | 0.45 | 0.45 | 0.45 | 0.45 | 0.45 |
| Hydroquinone | 23.3 | — | — | — | — | — | — | — |
| Sodium erythorbinate | — | 45.8 | — | 22.9 | 22.9 | 34.4 | 11.5 | 22.9 |
| Compound B-1 of the present invention | — | — | 45.0 | 22.5 | — | 11.3 | 33.8 | 22.5 |
| Compound B-44 of the present invention | — | — | — | — | 22.5 | — | — | — |
| Water | to 1 liter | | | | | | | |
| pH adjusted to | 10.5 | 10.5 | 10.5 | 10.5 | 10.5 | 10.5 | 10.5 | 10.5 |
| Remarks | Comparison | Comparison | Comparison | Comparison | Invention | Invention | Invention | Invention |

Developers were prepared as shown in Table 4, and a fixer was prepared in the same manner as in Example 1.

The samples thus prepared were exposed through an interference filter having a peak at 488 nm and continuous optical wedges for $10^{-5}$ of emission period with xenon flash. The exposed samples were developed with he developers shown in Table 4 at 35° C. for 30 seconds, and then were subjected to fixing, washing and drying processings. These processings were carried out by using an automatic developing machine FG-680AG produced by Fuji Photo Film Co., Ltd. The evaluations were carried in the same manner as in Example 1.

TABLE 5

| Sample No. | Developer No. | Fog | Sensitivity (S1.5) | Gradation | Remarks |
|---|---|---|---|---|---|
| 9 | D-9 | 0.04 | 100 | 28.1 | Comparison |
| 10 | D-10 | 0.04 | 87 | 12.0 | Comparison |
| 11 | D-11 | 0.04 | 107 | 7.5 | Comparison |
| 12 | D-12 | 0.04 | 98 | 18.2 | Invention |
| 13 | D-13 | 0.04 | 97 | 19.9 | Invention |
| 14 | D-14 | 0.04 | 103 | 15.0 | Invention |
| 15 | D-15 | 0.04 | 95 | 22.8 | Invention |
| 16 | D-16 | 0.04 | 100 | 27.3 | Invention |

As is apparent from the results shown in Table 5, the processing method according to the present invention provides high contrast images having high sensitivity. Furthermore, ultrahigh contrast images having high sensitivity can be obtained by adjusting a carbonate concentration of the developer to 0.5 mol/l or more.

Accordingly, the present invention provides a processing method of a silver halide black-and-white photographic material which can provides ultrahigh images having high sensitivity by using a developer containing no dihydroxybenzene developing agent.

While the invention has been described in detail and with reference to specific embodiments thereof, it will be apparent to one skilled in the art that various changes and modifications can be made therein without departing from the spirit and scope thereof.

What is claimed is:

1. A development processing method of a silver halide black-and-white photographic material, which comprises the steps of (a) exposing a silver halide photographic material comprising a support having thereon at least one light-sensitive silver halide emulsion layer, and (b) developing the exposed silver halide photographic material with a developer, wherein at least one layer of the light-sensitive silver halide emulsion layer and a hydrophilic colloid layer contains at least one hydrazine derivative represented by the following formula (I);

the developer contains substantially no dihydroxybenzene compound; and the developer contains (1) at least one developing agent selected from ascorbic acid, erythorbic acid and alkali metal salts thereof, (2) a developing agent represented by the following formula (II) in an amount of from $5\times10^{-3}$ to 0.5 mol per liter of the developer, and (3) an auxiliary developing agent exhibiting a superadditive property:

$$R_1-\underset{\underset{A_1}{|}}{N}-\underset{\underset{A_2}{|}}{N}-G_1-R_2 \qquad (I)$$

wherein $R_1$ represents an aliphatic group or an aromatic group;

$R_2$ represents a hydrogen atom, an alkyl group, an aryl group, an unsaturated heterocyclic group, an alkoxy group, an aryloxy group, an amino group or a hydrazino group;

$G_1$ represents —CO—, —$SO_2$—, —SO—, —PO($R_3$)—, —CO—CO—, a thiocarbonyl group or an iminomethylene group;

$A_1$ and $A_2$ are both a hydrogen atom, or one of them is a hydrogen atom and the other is an alkylsulfonyl group, an arylsulfonyl group or an acyl group;

$R_3$ has the same meaning as $R_2$, but it may be different from $R_2$:

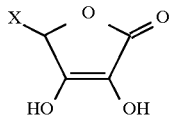

(II)

wherein X represents a hydrogen atom, an aryl group, a heterocyclic group or a group represented by the following formula (A):

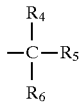

(A)

wherein $R_4$, $R_5$ and $R_6$ are the same or different and each represents a hydrogen atom or a substituent other than a hydroxyl group.

2. The development processing method as claimed in claim 1, wherein the developer has a pH of from 9.5 to 11.0.

3. The development processing method as claimed in claim 1, wherein the auxiliary developing agent exhibiting a superadditive property is at least one of a 1-phenyl-3-pryrazolidone compound and a p-aminophenol compound.

4. The development processing method as claimed in claim 1, wherein the developer contains carbonate in an amount of 0.5 mol/l or more.

5. The development processing method as claimed in claim 1, wherein the developing agent represented by formula (II) is a compound represented by the following formula (B):

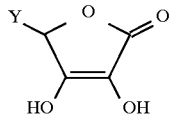

(B)

wherein Y represents a hydrogen atom or a substituent represented by the following formula (C):

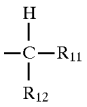

(C)

wherein $R_{11}$ and $R_{12}$ are the same or different and each represents a hydrogen atom, an alkyl group, an alkoxy group, an acyloxy group or an oxycarbonyl group.

6. The development processing method as claimed in claim 5, wherein $R_{11}$ is an alkoxy group or an acyloxy group; and $R_{12}$ is an alkyl group which is substituted with an alkoxy or acyloxy group.

7. The development processing method as claimed in claim 5, wherein the compound represented by formula (B) is a compound represented by the following formula (D):

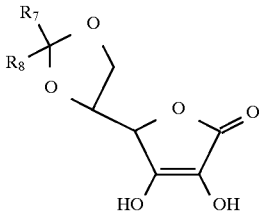

(D)

wherein $R_7$ and $R_8$ are the same or different and each represents a hydrogen atom, an alkyl group, an aryl group or an alkenyl group, and the alkyl groups represented by $R_7$ and $R_8$ may be bonded to form a ring structure.

8. The development processing method as claimed in claim 7, wherein at least one of $R_7$ and $R_8$ is a substituent other than a hydrogen atom.

9. The development processing method as claimed in claim 7, wherein the compound represented by formula (D) is a compound represented by a member selected from the group consisting of the following compounds B-1 to B-17:

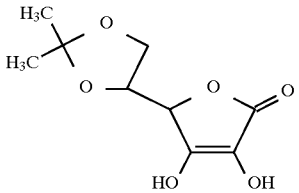

B-1

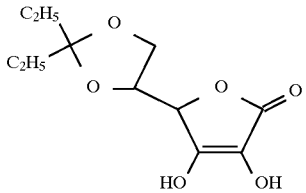

B-2

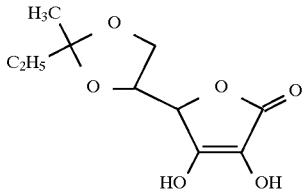

B-3

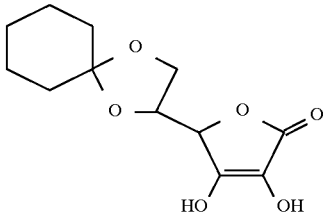

B-4

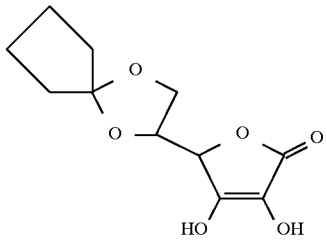

B-5

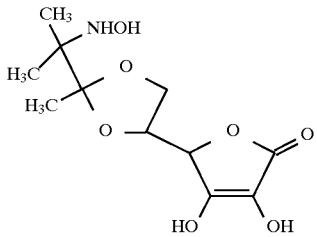

B-6

-continued

B-7

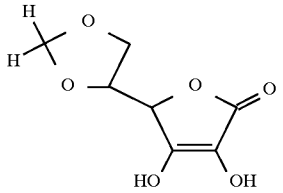

B-8

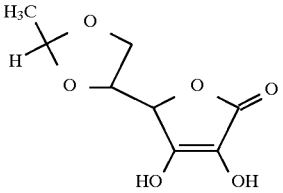

B-9

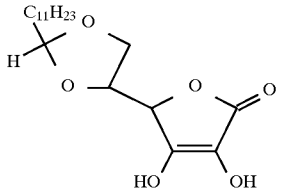

B-10

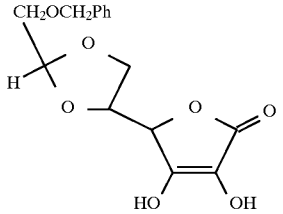

B-11

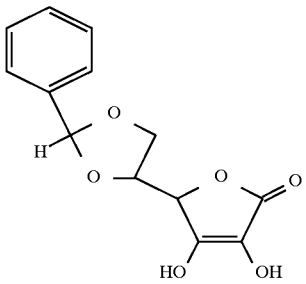

B-12

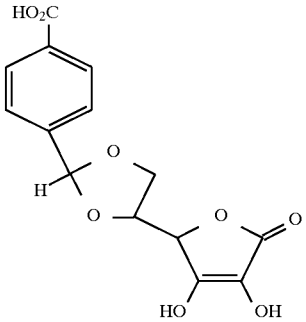

-continued

B-13

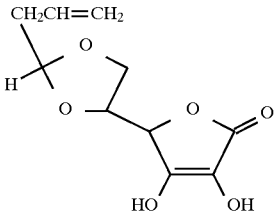

B-14

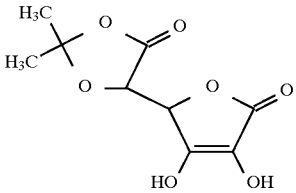

B-15

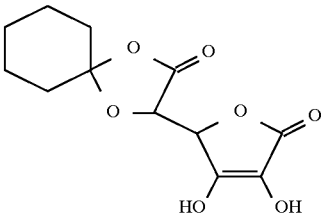

B-16

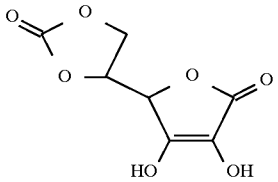

B-17

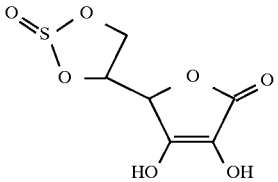

10. The development processing method as claimed in claim 1, wherein the hydrazine derivative is in an amount of $1\times10^{-6}$ to $5\times10^{-2}$ mol per mol of silver halide.

11. The development processing method as claimed in claim 1, wherein the developing agent (1) is in an amount of $5\times10^{-3}$ to 1 mol per liter of the developer.

12. The development processing method as claimed in claim 1, wherein the auxiliary developing agent (3) is in an amount of $1\times10^{-3}$ to 0.1 mol per liter of the developer.

* * * * *